US006653271B2

(12) United States Patent
Hage et al.

(10) Patent No.: US 6,653,271 B2
(45) Date of Patent: Nov. 25, 2003

(54) COMPOSITION AND METHOD FOR BLEACHING A SUBSTRATE

(75) Inventors: Ronald Hage, Vlaardingen (NL); Simon Marinus Veerman, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 31 days.

(21) Appl. No.: 10/112,992

(22) Filed: Apr. 1, 2002

(65) Prior Publication Data

US 2003/0045442 A1 Mar. 6, 2003

Related U.S. Application Data

(62) Division of application No. 09/650,134, filed on Aug. 29, 2000.

(30) Foreign Application Priority Data

| | | |
|---|---|---|
| Sep. 1, 1999 | (WO) | PCT/GB99/02876 |
| Sep. 1, 1999 | (WO) | PCT/GB99/02878 |
| Mar. 1, 2000 | (GB) | 0004990 |

(51) Int. Cl.[7] ..... C11D 3/00; C11D 7/18; C11D 7/54

(52) U.S. Cl. ..... 510/312; 510/303; 510/340; 510/372; 510/376; 510/500; 8/111

(58) Field of Search ..... 510/303, 312, 510/340, 372, 376, 500; 8/111

(56) References Cited

U.S. PATENT DOCUMENTS

| | | | | |
|---|---|---|---|---|
| 4,217,105 A | | 8/1980 | Goodman | 8/111 |
| 5,580,485 A | * | 12/1996 | Feringa et al. | 510/311 |
| 6,140,294 A | | 10/2000 | Delroisse et al. | 510/309 |
| 6,165,963 A | | 12/2000 | Delroisse et al. | 510/376 |
| 6,242,409 B1 | | 6/2001 | Appel et al. | 510/376 |
| 6,245,115 B1 | | 6/2001 | Appel et al. | 8/111 |
| 6,340,661 B1 | * | 1/2002 | Van Deurzen et al. | 510/302 |
| 6,432,900 B1 | * | 8/2002 | Appel et al. | 510/376 |

FOREIGN PATENT DOCUMENTS

| | | |
|---|---|---|
| DE | 197 14 122 | 5/1997 |
| DE | 19721886 | 5/1997 |
| EP | 0 040 131 | 4/1981 |
| EP | 0 909 809 | 10/1997 |
| JP | 034497 | 7/1998 |
| WO | 95/27772 | 10/1995 |
| WO | 95/34628 | 12/1995 |
| WO | 96/06154 | 2/1996 |
| WO | 97/07124 | 2/1997 |
| WO | 97/38074 | 10/1997 |
| WO | 97/48710 | 12/1997 |
| WO | 97/48787 | 12/1997 |
| WO | 98/39098 | 9/1998 |
| WO | 98/39406 | 9/1998 |
| WO | 99/65905 | 12/1999 |
| WO | 00/12667 | 3/2000 |
| WO | 00/12808 | 3/2000 |
| WO | 00/29537 | 5/2000 |

OTHER PUBLICATIONS

Journal of Surfactants and Detergents, vol. 1, No. 2 (Apr. 1998), "Oxygen Bleaching Systems in Domestic Laundry" by Neil J. Milne, pp. 253–261.

* cited by examiner

*Primary Examiner*—Gregory Delcotto
(74) *Attorney, Agent, or Firm*—Milton L. Honig

(57) ABSTRACT

The invention relates to a liquid bleaching composition for catalytically bleaching substrates, especially laundry fabrics, with atmospheric oxygen or air. A liquid bleaching composition is provided comprising an organic substance which forms a complex with a transition metal, the complex catalysing bleaching of a substrate by atmospheric oxygen, and a liquid carrier or solvent, wherein the composition is substantially devoid of peroxygen bleach or a peroxy-based or -generating bleach system. Also provided is a method of bleaching a substrate comprising applying the liquid bleaching composition to the substrate. Also provided is a method of treating a textile by contacting the textile with the liquid bleaching composition, whereby the complex catalyses bleaching of the textile by atmospheric oxygen after the treatment.

16 Claims, No Drawings

COMPOSITION AND METHOD FOR BLEACHING A SUBSTRATE

This application is a divisional of U.S. Ser. No. 09/650,134, filed Aug. 29, 2000 pending.

FIELD OF INVENTION

This invention relates to compositions and methods for catalytically bleaching substrates with atmospheric oxygen, using a metal-ligand complex as catalyst, which compositions are formulated as liquids. This invention also relates to a method of treating textiles, such as laundry fabrics, using a metal-ligand complex as catalyst whereby bleaching with atmospheric oxygen is catalysed after the treatment, wherein the treatment composition is formulated as a liquid.

BACKGROUND OF INVENTION

Peroxygen bleaches are well known for their ability to remove stains from substrates. Traditionally, the substrate is subjected to hydrogen peroxide, or to substances which can generate hydroperoxyl radicals, such as inorganic or organic peroxides. Generally, these systems must be activated. One method of activation is to employ wash temperatures of 60° C. or higher. However, these high temperatures often lead to inefficient cleaning, and can also cause premature damage to the substrate.

A preferred approach to generating hydroperoxyl bleach species is the use of inorganic peroxides coupled with organic precursor compounds. These systems are employed for many commercial laundry powders. For example, various European systems are based on tetraacetyl ethylenediamine (TAED) as the organic precursor coupled with sodium perborate or sodium percarbonate, whereas in the United States laundry bleach products are typically based on sodium nonanoyloxybenzenesulphonate (SNOBS) as the organic precursor coupled with sodium perborate.

Precursor systems are generally effective but still exhibit several disadvantages. For example, organic precursors are moderately sophisticated molecules requiring multi-step manufacturing processes resulting in high capital costs. Also, precursor systems have large formulation space requirements so that a significant proportion of a laundry powder must be devoted to the bleach components, leaving less room for other active ingredients and complicating the development of concentrated powders. Moreover, precursor systems do not bleach very efficiently in countries where consumers have wash habits entailing low dosage, short wash times, cold temperatures and low wash liquor to substrate ratios.

Alternatively, or additionally, hydrogen peroxide and peroxy systems can be activated by bleach catalysts, such as by complexes of iron and the ligand N4Py (i.e. N,N-bis(pyridin-2-yl-methyl)-bis(pyridin-2-yl)methylamine) disclosed in WO95/34628, or the ligand Tpen (i.e. N,N,N',N'-tetra(pyridin-2-yl-methyl)ethylenediamine) disclosed in WO97/48787. These publications do not foresee a role in providing storage stable liquid bleaching compositions even if, according to these publications, molecular oxygen may be used as the oxidant as an alternative to peroxide generating systems.

As discussed by N. J. Milne in J. of Surfactants and Detergents, Vol 1, no 2, 253–261 (1998), it has long been thought desirable to be able to use atmospheric oxygen (air) as the source for a bleaching species. The use of atmospheric oxygen (air) as the source for a bleaching species would avoid the need for costly hydroperoxyl generating systems.

Unfortunately, air as such is kinetically inert towards bleaching substrates and exhibits no bleaching ability. Recently some progress has been made in this area. For example, Wo 97/38074 reports the use of air for oxidising stains on fabrics by bubbling air through an aqueous solution containing an aldehyde and a radical initiator. A broad range of aliphatic, aromatic and heterocyclic aldehydes is reported to be useful, particularly para-substituted aldehydes such as 4-methyl-, 4-ethyl- and 4-isopropyl benzaldehyde, whereas the range of initiators disclosed includes N-hydroxysuccinimide, various peroxides and transition metal coordination complexes.

However, although this system employs molecular oxygen from the air, the aldehyde component and radical initiators such as peroxides are consumed during the bleaching process. These components must therefore be included in the composition in relatively high amounts so as not to become depleted before completion of the bleaching process in the wash cycle. Moreover, the spent components represent a waste of resources as they can no longer participate in the bleaching process.

Accordingly, it would be desirable to be able to provide a bleaching system based on atmospheric oxygen or air that does not rely primarily on hydrogen peroxide or a hydroperoxyl generating system, and that does not require the presence of organic components such as aldehydes that are consumed in the process. Moreover, it would be desirable to provide such a bleaching system that is effective in aqueous medium.

It may also be noted that the known art teaches a bleaching effect only as long as the substrate is being subjected to the bleaching treatment. Thus, there is no expectation that hydrogen peroxide or peroxy bleach systems could continue to provide a bleaching effect on a treated substrate, such as a laundry fabric after washing and drying, since the bleaching species themselves or any activators necessary for the bleaching systems would be assumed to be removed from the substrate, or consumed or deactivated, on completing the wash cycle and drying.

It would be therefore also be desirable to be able to treat a textile such that, after the treatment is completed, a bleaching effect is observed on the textile. Furthermore, it would be desirable to be able to provide a bleach treatment for textiles such as laundry fabrics whereby residual bleaching occurs in the presence of air when the treated fabric has been treated and is dry. It would be desirable for the residual bleaching of dry textiles to be conducted irrespective of exposure to light.

A further disadvantage associated with conventional bleaching compositions based on hydrogen peroxide or peroxy systems such those containing organic peroxyacids is that the compositions tend to be chemically or physically unstable in the presence of liquid solvents, carriers or other liquid components such as surfactants, particularly when formulated as aqueous compositions. Consequently, when formulated as liquids, these bleaching compositions on the one hand do not exhibit satisfactory storage stability, resulting in a rapid loss of bleaching activity or in a loss of structural integrity, for example phase separation, or require the incorporation of additional stabilising systems to minimise these effects with attendant disadvantages in terms of cost or processing. Decomposition of a hydrogen peroxide or peroxy liquid bleaching composition in a sealed container leads to an increase in the internal pressure of the sealed container. The increase in the internal pressure leads to the possibility of the sealed container rupturing in a dangerous manner. In the presence of surfactants, decomposition of the hydrogen peroxide or peroxy liquid bleaching composition leads to foaming of the composition. On the other hand, liquid bleaching compositions are conveniently dosed into containers for storage or for use, or otherwise handled, and are desired by the consumer, particularly in the United States of America.

It would therefore also be desirable to be able to provide a bleaching composition in the form of a liquid, which is chemically and physically stable, without at least some of the disadvantages hitherto associated with liquid bleaching compositions. It would furthermore be desirable to be able to provide chemically and physically storage stable detergent bleaching compositions or rinse conditioning bleach compositions in the form of a liquid. Application WO00/29537, filed Nov. 9, 1999, was published after the filing date of the present application disclosing theoretical examples of compositions for bleaching with a transition metal complex in the absence of an added peroxygen bleach. Application WO00/29537 has no evidence of efficacy and includes two classes of ligands: some cross-bridged macrocyclic ligands and some macrocyclic ligands. The macrocyclic ligands are disclosed as manganese complexes and are not found in the priority document of WO00/29537; namely U.S. ser. No. 60/108,292 filed Nov. 13, 1998. The theoretical examples given are for a heavy-duty granular laundry detergent and heavy-duty liquid laundry detergent. In both these examples the exemplified bleach catalyst is 5,12-dimethyl-1,5,8,12-tetra-bicyclo[6.6.2.]hexadecane manganese (II) chloride. There are no examples demonstrating any bleaching effect. The use of manganese complexes in laundry applications is less preferred because of dye/textile damage under specific conditions.

SUMMARY OF INVENTION

We have now found that it is possible to achieve a chemically and physically stable bleaching composition in the form of a liquid, by using an organic substance that forms a complex which catalyses the bleaching of substrates using atmospheric oxygen or air, and formulating the organic substance in a liquid that is substantially devoid of peroxygen bleach or a peroxy-based or -generating bleach system. Moreover, we have found that these organic substances can be formulated together with detergent or rinse conditioning agents, in a liquid that is substantially devoid of peroxygen bleach or a peroxy-based or -generating bleach system, to provide chemically and physically stable detergent bleaching compositions or rinse conditioning bleach compositions, in the form of a liquid.

Accordingly, in a first aspect, the present invention a liquid bleaching composition comprising an organic substance which forms a complex with a transition metal, the complex catalysing bleaching of a substrate by atmospheric oxygen, and a liquid carrier or solvent, wherein the composition is substantially devoid of peroxygen bleach or a peroxy-based or -generating bleach system. The composition is therefore preferably insensitive or stable to catalase, which acts on peroxy species.

In a second aspect, the present invention provides a method of bleaching a substrate comprising applying to the substrate a liquid bleaching composition that comprises an organic substance which forms a complex with a transition metal, the complex catalysing bleaching of the substrate by atmospheric oxygen, and a liquid carrier or solvent, wherein the composition is substantially devoid of peroxygen bleach or a peroxy-based or -generating bleach system.

Furthermore, in a third aspect, the present invention provides the use of an organic substance which forms a complex with a transition metal, the complex catalysing bleaching of a substrate by the atmospheric oxygen, as a catalytic bleaching agent in a liquid bleaching composition substantially devoid of peroxygen bleach or a peroxy-based or -generating bleach system.

We have also found that the liquid bleaching compositions in accordance with the present invention are surprisingly effective in catalysing bleaching of substrates by atmospheric oxygen after treatment of the substrate.

Accordingly, in a fourth aspect, the present invention provides a method of treating a textile by contacting the textile with a liquid bleaching composition that comprises an organic substance which forms a complex with a transition metal, the complex catalysing bleaching by atmospheric oxygen, and a liquid carrier or solvent, wherein the composition is substantially devoid of peroxygen bleach or a peroxy-based or -generating bleach system, whereby the complex catalyses bleaching of the textile by atmospheric oxygen after the treatment.

The present invention requires all or the majority of the bleaching species in the liquid bleaching composition (on an equivalent weight basis) to be derived from atmospheric oxygen. Thus, the liquid composition will be made wholly or substantially devoid of peroxygen bleach or a peroxy-based or -generating bleach system. The organic substance is a catalyst for the bleaching process and, as such, is not consumed but can continue to participate in the bleaching process. Since the bleaching system of the type used in the liquid bleaching composition is catalytically activated and the bleaching species is derived from atmospheric oxygen, the present invention is advantageous in that it provides a bleaching composition which is not only convenient to handle by virtue of being in the form of a liquid, but which also is both cost-effective and environmentally friendly.

The liquid bleaching composition may be formulated as a concentrated bleaching liquid for direct application to a substrate, or for application to a substrate following dilution, such as dilution before or during use of the liquid composition by the consumer or in washing apparatus.

The liquid bleaching composition can for example be formulated as an aqueous medium, or so as to be dispersable into an aqueous medium, and is therefore particularly applicable to bleaching of laundry fabrics. Therefore, whilst the composition and method according to the present invention may be used for bleaching any suitable substrate, the preferred substrate is a laundry fabric. Bleaching may be carried out by simply leaving the substrate in contact for a sufficient period of time with a bleach medium constituted by or prepared from the liquid bleaching composition. Preferably, however, the bleach medium on or containing the substrate is agitated.

An advantage of the method according to the fourth aspect of the invention is that, by enabling a bleaching effect even after the textile has been treated, the benefits of bleaching can be prolonged on the textile. Furthermore, since a bleaching effect is conferred to the textile after the treatment, the treatment itself, such as a laundry wash cycle, may for example be shortened.

The present invention also extends to a commercial package comprising a liquid bleaching composition comprising a ligand or complex as defined below together with instructions for its use.

The present invention also extends to use of a ligand or complex as defined below in the manufacture of a liquid bleaching composition, the bleaching composition substantially devoid of peroxygen bleach or a peroxy-based or peroxy-generating bleach system.

DETAILED DESCRIPTION OF THE INVENTION

The catalyst may comprise a preformed complex of a ligand and a transition metal. Alternatively, the catalyst may comprise a free ligand that complexes with a transition metal already present in the water or that complexes with a transition metal present in the substrate. The catalyst may also be included in the form of a composition of a free ligand or a transition metal-substitutable metal-ligand complex, and a source of transition metal, whereby the complex is formed in situ in the medium. It is preferred that the catalyst is a pentadentate ligand or complex thereof.

The ligand forms a complex with one or more transition metals, in the latter case for example as a dinuclear complex. Suitable transition metals include for example: manganese in oxidation states II–V, iron II–V, copper I–III, cobalt I–III, titanium II–IV, tungsten IV–VI, vanadium II–V and molybdenum II–VI.

The transition metal complex preferably is of the general formula:

$$[M_aL_kX_n]Y_m$$

in which:

M represents a metal selected from Mn(II)–(III)–(IV)–(V), Cu(I)–(II)–(III), Fe (II)–(III)–(IV)–(V), Co(I)–(II)–(III), Ti(II)–(III)–(IV), V(II)–(III)–(IV)–(V), Mo(II)–(III)–(IV)–(V)–(VI) and W(IV)–(V)–(VI), preferably from Fe(II)–(III)–(IV)–(V);

L represents the ligand, preferably N,N-bis(pyridin-2-yl-methyl)-1,1-bis(pyridin-2-yl)-1-aminoethane, or its protonated or deprotonated analogue;

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents zero or an integer from 1 to 10;

m represents zero or an integer from 1 to 20.

Preferably, the complex is an iron complex comprising the ligand N,N-bis(pyridin-2-yl-methyl)-1,1-bis(pyridin-2-yl)-1-aminoethane. However, it will be appreciated that the pretreatment method of the present invention may instead, or additionally, use other ligands and transition metal complexes, provided that the complex formed is capable of catalysing stain bleaching by atmospheric oxygen. Suitable classes of ligands are described below:

(A) Ligands of the general formula (IA):

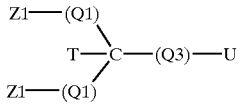

(IA)

wherein

Z1 groups independently represent a coordinating group selected from hydroxy, amino, —NHR or —$N(R)_2$ (wherein R=$C_{1-6}$-alkyl), carboxylate, amido, —NH—$C(NH)NH_2$, hydroxyphenyl, a heterocyclic ring optionally substituted by one or more functional groups E or a heteroaromatic ring optionally substituted by one or more functional groups E, the heteroaromatic ring being selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 and Q3 independently represent a group of the formula:

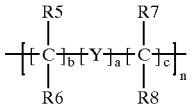

wherein $5 \geqq a+b+c \geqq 1$; $a$=0–5; $b$=0–5; $c$=0–5; $n$=0 or 1 (preferably n=0);

Y independently represents a group selected from —O—, —S—, —SO—, —SO2—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I;

T represents a non-coordinated group selected from hydrogen, hydroxyl, halogen, —R and —OR, wherein R represents alkyl, alkenyl, cycloalkyl, heterocycloalkyl, aryl, arylalkyl, heteroaryl or a carbonyl derivative group, R being optionally substituted by one or more functional groups E (preferably T=—H, —OH, methyl, methoxy or benzyl);

U represents either a non-coordinated group T independently defined as above or a coordinating group of the general formula (IIA), (IIIA) or (IVA):

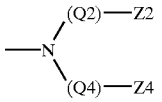

(IIA)

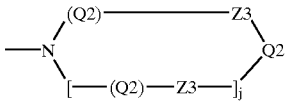

(IIIA)

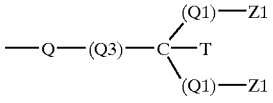

(IVA)

wherein

Q2 and Q4 are independently defined as for Q1 and Q3;

Q represents —N(T)— (wherein T is independently defined as above), or an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Z2 is independently defined as for Z1;

Z3 groups independently represent —N(T)— (wherein T is independently defined as above);

Z4 represents a coordinating or non-coordinating group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, or Z4 represents a group of the general formula (IIAa):

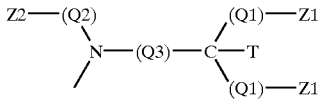

(IIAa)

and $1 \leqq j < 4$.

Preferably, Z1, Z2 and Z4 independently represent an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. More preferably, Z1, Z2 and Z4 independently represent groups selected from optionally substituted pyridin-2-yl, optionally substituted imidazol-2-yl, optionally substituted imidazol-4-yl, optionally substituted pyrazol-1-yl, and optionally substituted quinolin-2-yl. Most preferred is that Z1, Z2 and Z4 each represent optionally substituted pyridin-2-yl.

The groups Z1, Z2 and Z4 if substituted, are preferably substituted by a group selected from $C_{1-4}$-alkyl, aryl, arylalkyl, heteroaryl, methoxy, hydroxy, nitro, amino, carboxyl, halo, and carbonyl. Preferred is that Z1, Z2 and Z4 are each substituted by a methyl group. Also, we prefer that the Z1 groups represent identical groups.

Each Q1 preferably represents a covalent bond or $C_1$–$C_4$-alkylene, more preferably a covalent bond, methylene or ethylene, most preferably a covalent bond.

Group Q preferably represents a covalent bond or $C_1$–$C_4$-alkylene, more preferably a covalent bond.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Non-coordinated group T preferably represents hydrogen, hydroxy, methyl, ethyl, benzyl, or methoxy.

In one aspect, the group U in formula (IA) represents a coordinating group of the general formula (IIA):

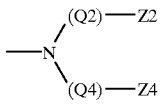

(IIA)

According to this aspect, it is preferred that Z2 represents an optionally substituted heterocyclic ring or an optionally substituted heteroaromatic ring selected from pyridine, pyrimidine, pyrazine, pyrazole, imidazole, benzimidazole, quinollne, Quinoxaline, triazole, isoquinoline, carbazole, indole, isoindole, oxazole and thiazole, more preferably optionally substituted pyridin-2-yl or optionally substituted benzimidazol-2-yl.

It is also preferred, in this aspect, that Z4 represents an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole, more preferably optionally substituted pyridin-2-yl, or an non-coordinating group selected from hydrogen, hydroxy, alkoxy, alkyl, alkenyl, cycloalkyl, aryl, or benzyl.

In preferred embodiments of this aspect, the ligand is selected from:

1,1-bis(pyridin-2-yl)-N-methyl-N-(pyridin-2-ylmethyl) methylamine;

1,1-bis(pyridin-2-yl)-N,N-bis(6-methyl-pyridin-2-ylmethyl)methylamine;

1,1-bis(pyridin-2-yl)-N,N-bis(5-carboxymethyl-pyridin-2-ylmethyl)methylamine;

1,1-bis(pyridin-2-yl)-1-benzyl-N,N-bis(pyridin-2-ylmethyl)methylamine; and 1,1-bis(pyridin-2yl)-N,N-bis(benzimidazol-2-ylmethyl) methylamine.

In a variant of this aspect, the group Z4 in formula (IIA) represents a group of the general formula (IIAa):

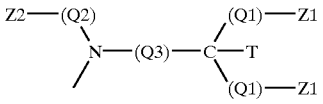

(IIAa)

In this variant, Q4 preferably represents optionally substituted alkylene, preferably —$CH_2$—CHOH—$CH_2$— or —$CH_2$—$CH_2$—$CH_2$—. In a preferred embodiment of this variant, the ligand is:

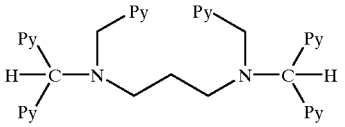

wherein —Py represents pyridin-2-yl.

In another aspect, the group U in formula (IA) represents a coordinating group of the general formula (IIIA):

(IIIA)

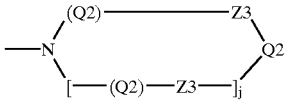

wherein j is 1 or 2, preferably 1.

According to this aspect, each Q2 preferably represents —$(CH_2)_n$— (n=2–4), and each Z3 preferably represents —N(R)— wherein R=H or $C_{1-4}$-alkyl, preferably methyl.

In preferred embodiments of this aspect, the ligand is selected from:

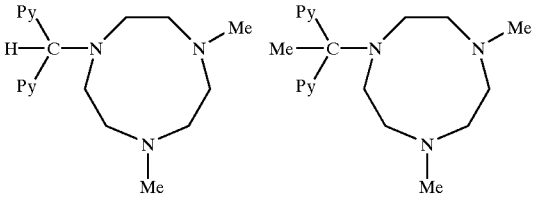

wherein —Py represents pyridin-2-yl.

In yet another aspect, the group U in formula (IA) represents a coordinating group of the general formula (IVA):

(IVA)

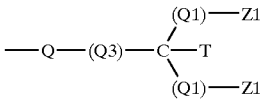

In this aspect, Q preferably represents —N(T)— (wherein T=—H, methyl, or benzyl) or pyridin-diyl.

In preferred embodiments of this aspect, the ligand is selected from:

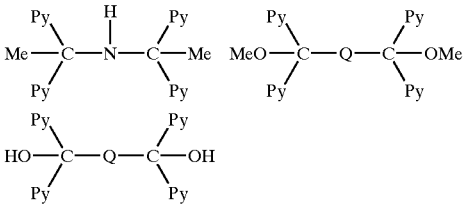

wherein —Py represents pyridin-2-yl, and —Q— represents pyridin-2,6-diyl.

(B) Ligands of the general formula (IB):

(IB)

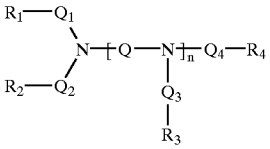

wherein n=1 or 2, whereby if n=2, then each —$Q_3$—$R_3$ group is independently defined;

$R_1$, $R_2$, $R_3$, $R_4$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E, $Q_1$, $Q_2$, $Q_3$, $Q_4$ and Q independently represent a group of the formula:

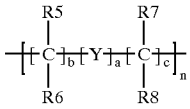

wherein $5 \geqq a+b+c \geqq 1$; $a$=0–5; $b$=0–5; $c$=0–5; $n$=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least two of $R_1$, $R_2$, $R_3$, $R_4$ comprise coordinating heteroatoms and no more than six heteroatoms are coordinated to the same transition metal atom.

At least two, and preferably at least three, of $R_1$, R2, R3, R4 independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

Preferably, substituents for groups $R_1$, $R_2$, $R_3$, $R_4$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

The groups $Q_1$, $Q_2$, $Q_3$, $Q_4$ preferably independently represent a group selected from —$CH_2$— and —$CH_2CH_2$—.

Group Q is preferably a group selected from —$(CH_2)_{2-4}$—, —$CH_2CH(OH)CH_2$—,

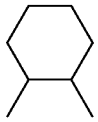

optionally substituted by methyl or ethyl,

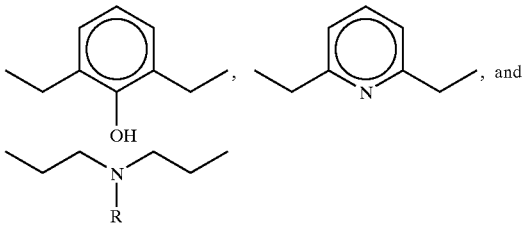

wherein R represents —H or $C_{1-4}$-alkyl.

Preferably, $Q_1$, $Q_2$, $Q_3$, $Q_4$ are defined such that a=b=0, c=1 and n=1, and Q is defined such that a=b=0, c=2 and n=1.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IIB):

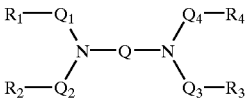

(IIB)

wherein $Q_1$, $Q_2$, $Q_3$, $Q_4$ are defined such that a=b=0, c=1 or 2 and n=1;

Q is defined such that a=b=0, c=2, 3 or 4 and n=1; and $R_1$, $R_2$, $R_3$, $R_4$, R7, R8 are independently defined as for formula (I).

Preferred classes of ligands according to this aspect, as represented by formula (IIB) above, are as follows:

(i) ligands of the general formula (IIB) wherein:

$R_1$, $R_2$, $R_3$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

Q is defined such that a=b=0, c=2 or 3 and n=1;

$R_1$, $R_2$, $R_3$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) ligands of the general formula (IIB) wherein:

$R_1$, $R_2$, $R_3$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_4$ represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_2$, $R_3$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_4$ represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

(iii) ligands of the general formula (IIB) wherein:

$R_1$, $R_4$ each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and $R_2$, $R_3$ each independently represent a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R=$C_{1-8}$-alkyl).

In this class, we prefer that:

Q is defined such that a=b=0, c=2 or 3 and n=1;

$R_1$, $R_4$ each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and $R_2$, $R_3$ each independently represent a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

Examples of preferred ligands in their simplest forms are:

N,N',N'-tris(3-methyl-pyridin-2-ylmethyl)-ethylenediamine;

N-trimethylammoniumpropyl-N,N',N'-tris(pyridin-2-ylmethyl)-ethylenediamine;

N-(2-hydroxyethylene)-N,N',N'-tris(pyridin-2-ylmethyl)-ethylenediamine;

N,N,N',N'-tetrakis(3-methyl-pyridin-2-ylmethyl)-ethylene-diamine;

N,N'-dimethyl-N,N'-bis(pyridin-2-ylmethyl)-cyclohexane-1,2-diamine;

N-(2-hydroxyethylene)-N,N',N'-tris(3-methyl-pyridin-2-ylmethyl)-ethylenediamine;

N-methyl-N,N',N'-tris(pyridin-2-ylmethyl)-ethylenediamine;

N-methyl-N,N',N'-tris(5-ethyl-pyridin-2-ylmethyl)-ethylenediamine;

N-methyl-N,N',N'-tris(5-methyl-pyridin-2-ylmethyl)-ethylenediamine;

N-methyl-N,N',N'-tris(3-methyl-pyridin-2-ylmethyl)-ethylenediamine;

N-benzyl-N,N',N'-tris(3-methyl-pyridin-2-ylmethyl)-ethylenediamine;

N-ethyl-N,N',N'-tris(3-methyl-pyridin-2-ylmethyl)-ethylenediamine;

N,N,N'-tris(3-methyl-pyridin-2-ylmethyl)-N'(2'-methoxyethyl-1)-ethylenediamine;

N,N,N'-tris(1-methyl-benzimidazol-2-yl)-N'-methyl-ethylenediamine;

N-(furan-2-yl)-N,N',N'-tris(3-methyl-pyridin-2-ylmethyl)-ethylenediamine;

N-(2-hydroxyethylene)-N,N',N'-tris(3-ethyl-pyridin-2-ylmethyl)-ethylenediamine;

N-methyl-N,N',N'-tris(3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl) ethylene-1,2-diamine;

N-ethyl-N,N',N'-tris(5-methyl-pyridin-2-ylmethyl) ethylene-1,2-diamine;

N-benzyl-N,N',N'-tris(5-methyl-pyridin-2-ylmethyl) ethylene-1,2-diamine;

N-(2-hydroxyethyl)-N,N',N'-tris(5-methyl-pyridin-2-ylmethyl)ethylene-1,2-diamine;

N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl) ethylene-1,2-diamine;

N-ethyl-N,N',N'-tris(3-ethyl-pyridin-2-ylmethyl) ethylene-1,2-diamine;

N-benzyl-N,N',N'-tris(3-ethyl-pyridin-2-ylmethyl) ethylene-1,2-diamine;

N-(2-hydroxyethyl)-N,N',N'-tris(3-ethyl-pyridin-2-ylmethyl)ethylene-1,2-diamine;

N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl) ethylene-1,2-diamine;

N-ethyl-N,N',N'-tris(5-ethyl-pyridin-2-ylmethyl) ethylene-1,2-diamine;

N-benzyl-N,N',N'-tris(5-ethyl-pyridin-2-ylmethyl) ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl) ethylene-1,2-diamine;

N-ethyl-N,N',N'-tris(3-methyl-pyridin-2-ylmethyl) ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl)ethylene-1,2-diamine.

(C) Ligands of the general formula (IC):

(IC)

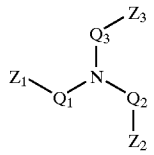

wherein $Z_1$, $Z_2$ and $Z_3$ independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

$Q_1$, $Q_2$, and $Q_3$ independently represent a group of the formula:

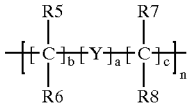

wherein $5 \geqq a+b+c \geqq 1$; $a$=0–5; $b$=0–5; $c$=0–5; $n$=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{16}$-alkylene optionally substituted by $C_{1-4}$-alkyl, —F, —Cl, —Br or —I.

$Z_1$ $Z_2$ and $Z_3$ each represent a coordinating group, preferably selected from optionally substituted pyridin-2-yl, optionally substituted imidazol-2-yl, optionally substituted imidazol-4-yl, optionally substituted pyrazol-1-yl, and optionally substituted quinolin-2-yl. Preferably, $Z_1$, $Z_2$ and $Z_3$ each represent optionally substituted pyridin-2-yl.

Optional substituents for the groups $Z_1$, $Z_2$ and $Z_3$ are preferably selected from $C_{1-4}$-alkyl, aryl, arylalkyl, heteroaryl, methoxy, hydroxy, nitro, amino, carboxyl, halo, and carbonyl, preferably methyl.

Also preferred is that $Q_1$, $Q_2$ and $Q_3$ are defined such that a=b=0, c=1 or 2, and n=1.

Preferably, each $Q_1$, $Q_2$ and $Q_3$ independently represent $C_{1-4}$-alkylene, more preferably a group selected from —$CH_2$— and —$CH_2CH_2$—.

The groups R5, R6, R7, R8 preferably independently represent a group selected from —H, hydroxy-$C_0$–$C_{20}$- alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, Co-$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

Preferably, the ligand is selected from tris(pyridin-2-ylmethyl)amine, tris(3-methyl-pyridin-2-ylmethyl)amine, tris(5-methyl-pyridin-2-ylmethyl)amine, and tris(6-methyl-pyridin-2-ylmethyl)amine.

(D) Ligands of the general formula (ID):

(ID)

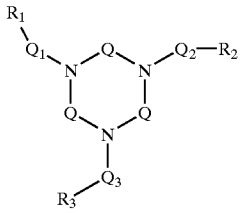

wherein $R_1$, $R_2$, and $R_3$ independently represent a group selected from hydrogen, hydroxyl, halogen, —NH—C(NH)$NH_2$, —R and —OR, wherein R=alkyl, alkenyl, cycloalkyl, heterocycloalkyl, aryl, heteroaryl or a carbonyl derivative group, R being optionally substituted by one or more functional groups E;

Q independently represent a group selected from $C_{2-3}$-alkylene optionally substituted by H, benzyl or $C_{1-8}$-alkyl;

$Q_1$, $Q_2$ and $Q_3$ independently represent a group of the formula:

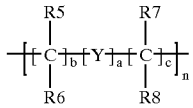

wherein $5 \geqq a+b+c \geqq 1$; $a$=0–5; $b$=0–5; $c$=0–5; $n$=1 or 2;

Y independently represents a group selected from —O—, —S—, —SO—, —$SO_2$—, —C(O)—, arylene, alkylene, heteroarylene, heterocycloalkylene, -(G)P—, —P(O)— and -(G)N—, wherein G is selected from hydrogen, alkyl, aryl, arylalkyl, cycloalkyl, each except hydrogen being optionally substituted by one or more functional groups E; and R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I, provided that at least one, preferably at least two, of $R_1$, $R_2$ and $R_3$ is a coordinating group.

At least two, and preferably at least three, of $R_1$, $R_2$ and $R_3$ independently represent a group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole. Preferably, at least two of $R_1$, $R_2$, $R_3$ each independently represent a coordinating group selected from optionally substituted pyridin-2-yl1 optionally substituted imidazol-2-yl, optionally substituted imidazol-4-yl, optionally substituted pyrazol-1-yl, and optionally substituted quinolin-2-yl.

Preferably, substituents for groups $R_1$, $R_2$, $R_3$, when representing a heterocyclic or heteroaromatic ring, are selected from $C_{1-4}$-alkyl, aryl, arylalkyl, heteroaryl, methoxy, hydroxy, nitro, amino, carboxyl, halo, and carbonyl.

Preferably, $Q_1$, $Q_2$ and $Q_3$ are defined such that a=b=0, c=1,2, 3 or 4 and n=1. Preferably, the groups $Q_1$, $Q_2$ and $Q_3$ independently represent a group selected from —$CH_2$— and —$CH_2CH_2$—.

Group Q is preferably a group selected from —$CH_2CH_2$— and —$CH_2CH_2CH_2$—.

The groups R5, R6, R7, R8 preferably independently represent a group selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulfo-$C_0$–$C_{20}$-alkyl and esters and salts thereof, sulfamoyl-$C_0$–$C_{20}$-alkyl, amino-$C_0$–$C_{20}$-alkyl, aryl-$C_0$–$C_{20}$-alkyl, $C_0$–$C_{20}$-alkyl, alkoxy-$C_0$–$C_8$-alkyl, carbonyl-$C_0$–$C_6$-alkoxy, and $C_0$–$C_{20}$-alkylamide. Preferably, none of R5–R8 is linked together.

In a preferred aspect, the ligand is of the general formula (IID):

(IID)

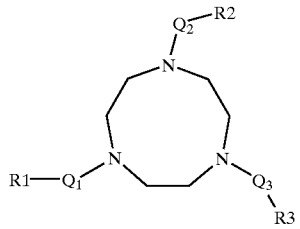

wherein R1, R2, R3 are as defined previously for R1, R2, R3, and $Q_1$, $Q_2$, $Q_3$ are as defined previously.

Preferred classes of ligands according to this preferred aspect, as represented by formula (IID) above, are as follows:

(i) ligands of the general formula (IID) wherein:

R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole.

In this class, we prefer that:

R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl.

(ii) ligands of the general formula (IID) wherein:

two of R1, R2, R3 each independently represent a coordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole; and one of R1, R2, R3 represents a group selected from hydrogen, $C_{1-20}$ optionally substituted alkyl, $C_{1-20}$ optionally substituted arylalkyl, aryl, and $C_{1-20}$ optionally substituted $NR_3^+$ (wherein R═$C_{1-8}$-alkyl).

In this class, we prefer that:

two of R1, R2, R3 each independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl; and one of R1, R2, R3 represents a group selected from hydrogen, $C_{1-10}$ optionally substituted alkyl, $C_{1-5}$-furanyl, $C_{1-5}$ optionally substituted benzylalkyl, benzyl, $C_{1-5}$ optionally substituted alkoxy, and $C_{1-20}$ optionally substituted $N^+Me_3$.

In especially preferred embodiments, the ligand is selected from:

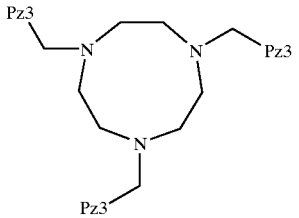

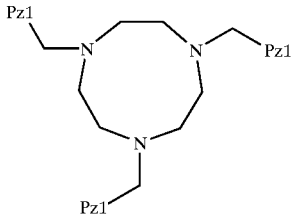

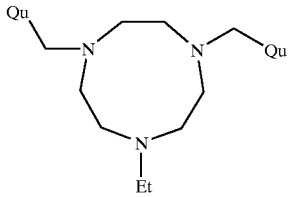

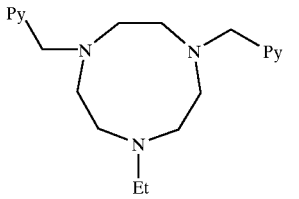

-continued

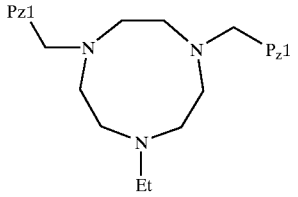

wherein —Et represents ethyl, —Py represents pyridin-2-yl, Pz3 represents pyrazol-3-yl, Pz1 represents pyrazol-1-yl, and Qu represents quinolin-2-yl.

(E) Ligands of the general formula (IE):

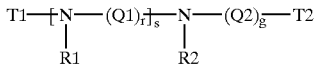

(IE)

wherein g represents zero or an integer from 1 to 6;

r represents an integer from 1 to 6;

s represents zero or an integer from 1 to 6;

Q1 and Q2 independently represent a group of the formula:

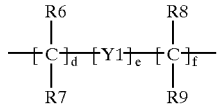

wherein $5 \geqq d+e+f \geqq 1$; $d$=0–5; $e$=0–5; $f$=0–5;

each Y1 independently represents a group selected from –O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

if s>1, each —[—N(R1)—$(Q1)_r$—]— group is independently defined;

R1, R2, R6, R7, R8, R9 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R6 together with R7, or R8 together with R9, or both, represent oxygen, or R6 together with R8 and/or independently R7 together with R9, or R6 together with R9 and/or independently R7 together with R8, represent $C_{1-6}$-alkylene optionally substituted by $C_{1-4}$-alkyl, —F, —Cl, —Br or —I;

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent ═CH—R10, wherein R10 is as defined for R1–R9, or T1 and T2 may together (-T2-T1-) represent a covalent bond linkage when s>1 and g>0;

if T1 and T2 together represent a single bond linkage, Q1 and/or Q2 may independently represent a group of the formula: ═CH—[—Y1—]$_e$—CH═ provided R1 and/or R2 are absent, and R1 and/or R2 may be absent provided Q1 and/or Q2 independently represent a group of the formula: ═CH—[—Y1—]$_e$—CH═.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, CO—$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group is independently defined according to the formula for Q1, Q2, preferably being alkylene or hydroxy-alkylene or a heteroaryl-containing bridge, more preferably $C_{16}$-alkylene optionally substituted by $C_{1-4}$-alkyl, —F, —Cl, —Br or —I.

In a first variant according to formula (IE), the groups T1 and T2 together form a single bond linkage and s>1, according to general formula (IIE):

(IIE)

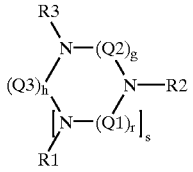

wherein R3 independently represents a group as defined for R1–R9; Q3 independently represents a group as defined for Q1, Q2; h represents zero or an integer from 1 to 6; and ss=s-1.

In a first embodiment of the first variant, in general formula (IIE), ss=1, 2 or 3; r=g=h=1; d=2 or 3; e=f=O; R6=R7=H, preferably such that the ligand has a general formula selected from:

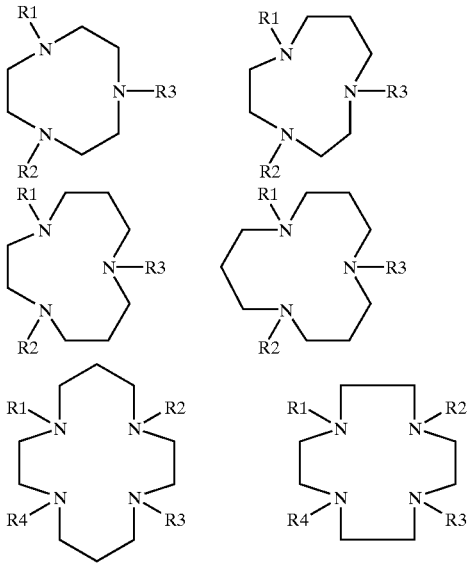

-continued

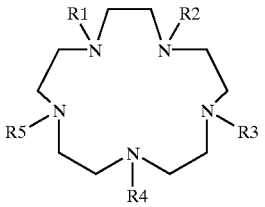

In these preferred examples, R1, R2, R3 and R4 are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

In a second embodiment of the first variant, in general formula (IIE), ss=2 and r=g=h=1, according to the general formula:

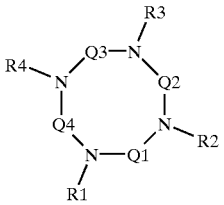

In this second embodiment, preferably R1–R4 are absent; both Q1 and Q3 represent ═CH—[—Y—]$_e$—CH═; and both Q2 and Q4 represent —$CH_2$[—Y1—]$_n$—$CH_2$—.

Thus, preferably the ligand has the general formula:

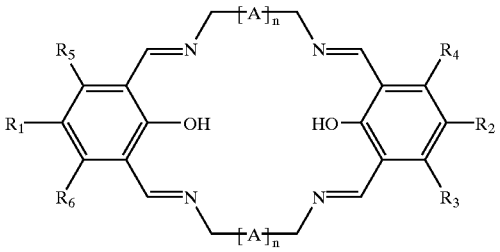

wherein A represents optionally substituted alkylene optionally interrupted by a heteroatom; and n is zero or an integer from 1 to 5.

Preferably, R1–R6 represent hydrogen, n=1 and A≡$CH_2$—, —CHOH—, —$CH_2$N(R)$CH_2$— or —$CH_2CH_2$N(R)$CH_2CH_2$— wherein R represents hydrogen or alkyl, more preferably A≡$CH_2$—, —CHOH— or —$CH_2CH_2$NH$CH_2CH_2$—.

In a second variant according to formula (1E), T1 and T2 independently represent groups R4, R5 as defined for R1–R9, according to the general formula (IIIE):

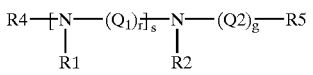

(IIIE)

In a first embodiment of the second variant, in general formula (IIIE), s=1; r=1; g=0; d=f=1; e=0–4; Y1=—$CH_2$—; and R1 together with R4, and/or R2 together with R5, independently represent =CH—R10, wherein R10 is as defined for R1–R9. In one example, R2 together with R5 represents =CH—R10, with R1 and R4 being two separate groups. Alternatively, both R1 together with R4, and R2 together with R5 may independently represent =CH—R10. Thus, preferred ligands may for example have a structure selected from:

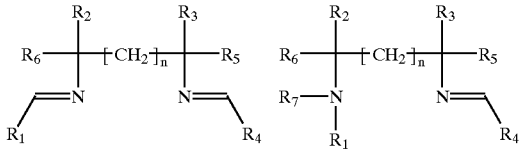

wherein n=0–4.

Preferably, the ligand is selected from:

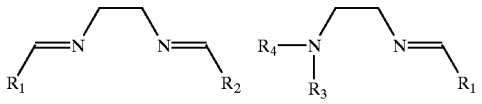

wherein R1and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

In a second embodiment of the second variant, in general formula (IIIE), s=1; r=1; g=0; d=f=1; e=1–4; Y1=—C(R')(R"), wherein R' and R" are independently as defined for R1–R9. Preferably, the ligand has the general formula:

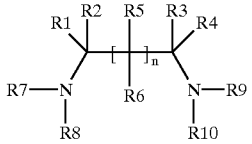

The groups R1, R2, R3, R4, R5 in this formula are preferably —H or $C_0$–$C_{20}$-alkyl, n=0 or 1, R6 is —H, alkyl, —OH or —SH, and R7, R8, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

In a third embodiment of the second variant, in general formula (IIIE), s=0; g=1; d=e=0; f=1–4. Preferably, the ligand has the general formula:

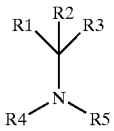

This class of ligand is particularly preferred according to the invention.

More preferably, the ligand has the general formula:

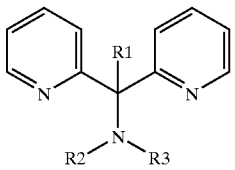

wherein R1, R2, R3 are as defined for R2, R4, R5.

In a fourth embodiment of the second variant, the ligand is a pentadentate ligand of the general formula (IVE):

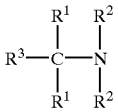

(IVE)

wherein each $R^1$, $R^2$ independently represents —$R^4$—$R^5$, $R^3$ represents hydrogen, optionally substituted alkyl, aryl or arylalkyl, or —$R^4$—$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

Ligands of the class represented by general formula (IVE) are also particularly preferred according to the invention. The ligand having the general formula (IVE), as defined above, is a pentadentate ligand. By 'pentadentate' herein is meant that five hetero atoms can coordinate to the metal M ion in the metal-complex.

In formula (IVE), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand of formula (IVE) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group.

Preferably, the heteroaryl group is linked to methylamine, and preferably to the N atom thereof, via a methylene group. Preferably, the ligand of formula (IVE) contains at least one optionally substituted amino-alkyl side group, more preferably two amino-ethyl side groups, in particular 2-(N-alkyl) amino-ethyl or 2-(N,N-dialkyl)amino-ethyl.

Thus, in formula (IVE) preferably $R^1$ represents pyridin-2-yl or $R^2$ represents pyridin-2-yl-methyl. Preferably $R^2$ or $R^1$ represents 2-amino-ethyl, 2-(N-(m)ethyl)amino-ethyl or 2-(N,N-di(m)ethyl)amino-ethyl. If substituted, $R^5$ preferably represents 3-methylpyridin-2-yl. $R^3$ preferably represents hydrogen, benzyl or methyl.

Examples of preferred ligands of formula (IVE) in their simplest forms are:

(i) pyridin-2-yl containing ligands such as:

N,N-bis(pyridin-2-yl-methyl)-bis(pyridin-2-yl) methylamine;

N,N-bis(pyrazol-1-yl-methyl)-bis(pyridin-2-yl) methylamine;

N,N-bis(imidazol-2-yl-methyl)-bis(pyridin-2-yl) methylamine;

N,N-bis(1,2,4-triazol-1-yl-methyl)-bis(pyridin-2-yl) methylamine;

N,N-bis(pyridin-2-yl-methyl)-bis(pyrazol-1-yl) methylamine;

N,N-bis(pyridin-2-yl-methyl)-bis(imidazol-2-yl) methylamine;

N,N-bis(pyridin-2-yl-methyl)-bis(1,2,4-triazol-1-yl) methylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-1-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-amino-ethyl containing ligands such as:

N,N-bis(2-(N-alkyl)amino-ethyl)-bis(pyridin-2-yl) methylamine;

N,N-bis(2-(N-alkyl)amino-ethyl)-bis(pyrazol-1-yl) methylamine;

N,N-bis(2-(N-alkyl)amino-ethyl)-bis(imidazol-2-yl) methylamine;

N,N-bis(2-(N-alkyl)amino-ethyl)-bis(1,2,4-triazol-1-yl)methylamine;

N,N-bis(2-(N,N-dialkyl)amino-ethyl)-bis(pyridin-2-yl) methylamine;

N,N-bis(2-(N,N-dialkyl)amino-ethyl)-bis(pyrazol-1-yl)methylamine;

N,N-bis(2-(N,N-dialkyl)amino-ethyl)-bis(imidazol-2-yl)methylamine;

N,N-bis(2-(N,N-dialkyl)amino-ethyl)-bis(1,2,4-triazol-1-yl)methylamine;

N,N-bis(pyridin-2-yl-methyl)-bis(2-amino-ethyl) methylamine;

N,N-bis(pyrazol-1-yl-methyl)-bis(2-amino-ethyl) methylamine;

N,N-bis(imidazol-2-yl-methyl)-bis(2-amino-ethyl) methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl) methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In a fifth embodiment of the second variant, the ligand represents a pentadentate or hexadentate ligand of general formula (VE):

$$R^1R^1N—W—NR^1R^2 \quad \text{(VE)}$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand having the general formula (VE), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (VE), two hetero atoms are linked by the bridging group W and one coordinating hetero atom is contained in each of the three $R^1$ groups. Preferably, the coordinating hetero atoms are nitrogen atoms.

The ligand of formula (VE) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (VE), preferably via an alkylene group, more preferably a methylene group. Most preferably, the heteroaryl group is a 3-methyl-pyridin-2-yl group linked to an N atom via methylene.

The group $R^2$ in formula (VE) is a substituted or unsubstituted alkyl, aryl or arylalkyl group, or a group R'. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from $—CH_2CH_2—$, $—CH_2CH_2CH_2—$, $—CH_2CH_2CH—_2CH_2—$, $—CH_2—C_6H_4—CH_2—$, $—CH_2—C_6H_{10}—CH_2—$, and $—CH_2–Cl_{10}H_6—CH_2—$ (wherein $—C_6H_4—$, $—C_6H_{10}—$, $—C_{10}H_6—$ can be ortho-, para-, or meta-$C_6H_4—$, $—C_6H_{10}—$, $—C_{10}H_6—$). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methylpyridin-2-yl.

(F) Ligands of the classes disclosed in WO-A-98/39098 and WO-A-98/39406.

The counter ions Y in formula (Al) balance the charge z on the complex formed by the ligand L, metal M and coordinating species X. Thus, if the charge z is positive, Y may be an anion such as $RCOO^-$,$BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF6^-$, $RSO_3^-$ (in particular $CF_3SO_3^-$), $RSO_4^-$, $SO_4^{2-}$, $NO_3^-$, $F^-$, $Cl^-$, $Br^-$, and $I^-$, wherein R represents hydrogen or optionally substituted phenyl, naphthyl or $C_1$–$C_4$ alkyl.

It will be appreciated that the complex (A1) can be formed by any appropriate means, including in situ formation whereby precursors of the complex are transformed into the active complex of general formula (A1) under conditions of storage or use. Preferably, the complex is formed as a well-defined complex or in a solvent mixture comprising a salt of the metal M and the ligand L or ligand L-generating species. Alternatively, the catalyst may be formed in situ from suitable precursors for the complex, for example in a solution or dispersion containing the precursor materials. In one such example, the active catalyst may be formed in situ in a mixture comprising a salt of the metal M and the ligand L, or a ligand L-generating species, in a suitable solvent. Thus, for example, if M is iron, an iron salt such as $FeSO_4$ can be mixed in solution with the ligand L, or a ligand L-generating species, to form the active complex. Thus, for example, the composition may formed from a mixture of the ligand L and a metal salt $MX_n$ in which preferably n=1–5, more preferably 1–3. In another such example, the ligand L, or a ligand L-generating species, can be mixed with metal M ions present in the substrate or wash liquor to form the active catalyst in situ. Suitable ligand L-generating species include metal-free compounds or metal coordination complexes that comprise the ligand L and can be substituted by metal M ions to form the active complex according the formula (A1).

Throughout the description and claims generic groups have been used, for example alkyl, alkoxy, aryl. Unless otherwise specified the following are preferred group restrictions that may be applied to generic groups found within compounds disclosed herein:

alkyl: C1–C6-alkyl, alkenyl: C2–C6-alkenyl, cycloalkyl: C3–C8-cycloalkyl, alkoxy: C1–C6-alkoxy, alkylene: selected from the group consisting of: methylene; 1,1-ethylene; 1,2-ethylene; 1,1-propylene; 1,2-propylene; 1,3-propylene; 2,2-propylene; butan-2-ol-1, 4-diyl; propan-2-ol-1,3-diyl; and 1,4-butylene, aryl: selected from homoaromatic compounds having a molecular weight under 300, arylene: selected from the group consisting of: 1,2-benzene; 1,3-benzene; 1,4-benzene; 1,2-naphthalene; 1,3-naphthalene; 1,4-naphthalene; 2,3-naphthalene; phenol-2,3-diyl; phenol-2,4-diyl; phenol-2,5-diyl; and phenol-2,-6-diyl, heteroaryl: selected from the group consisting of: pyridinyl; pyrimidinyl; pyrazinyl; triazolyl, pyridazinyl; 1,3, 5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, heteroarylene: selected from the group consisting of: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, heterocycloalkyl: selected from the group consisting of: pyrrolinyl; pyrrolidinyl; morpholinyl; piperidinyl; piperazinyl; hexamethylene imine; and oxazolidinyl, amine: the group $—N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulphonate: the group $—S(O)_2OR$, wherein R is selected from: hydrogen; C1–C6-alkyl; phenyl; C1–C6-alkyl-C6H5; Li; Na; K; Cs; Mg; and Ca, sulphate: the group $—OS(O)_2OR$, wherein R is selected from: hydrogen; C1–C6-alkyl; phenyl; C1–C6-alkyl-C6H5; Li; Na; K; Cs; Mg; and Ca, sulphone: the group $—S(O)_2R$, wherein R is selected from: hydrogen; C1–C6-alkyl; phenyl; C1–C6-alkyl- C6H5 and amine (to give sulphonamide) selected from the group: —NR'2, wherein each R' is independently selected from: hydrogen; C1–C6-alkyl; C1–C6-alkyl-C6H5; and phenyl, wherein when both R' are C1–C6-alkyl both R1 together may form an —NC3 to an —NC5 heterocyclic ring with any remaining alkyl chain forming an alkyl substituent to the heterocyclic ring, carboxylate derivative: the group —C(O)OR, wherein R is selected from: hydrogen, C1–C6-alkyl; phenyl; C1–C6-alkyl-$C_6$H5, Li; Na; K; Cs; Mg; and Ca, carbonyl derivative: the group —C(O)R, wherein R is selected from: hydrogen; C1–C6-alkyl; phenyl; C1–C6-alkyl-$C_6$H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —P(O) $(OR)_2$, wherein each R is independently selected from: hydrogen; C1–C6-alkyl; phenyl; C1–C6-alkyl-C6H5; Li; Na; K; Cs; Mg; and Ca, phosphate: the group —OP(O) $(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

alkyl: C1–C4-alkyl, alkenyl: C3–C6-alkenyl, cycloalkyl: C6–C8-cycloalkyl, alkoxy: C1–C4-alkoxy, alkylene: selected from the group consisting of: methylene; 1,2-ethylene; 1,3-propylene; butan-2-ol-1,4-diyl; and 1,4-butylene, aryl: selected from group consisting of: phenyl; biphenyl, naphthalenyl; anthracenyl; and phenanthrenyl, arylene: selected from the group consisting of: 1,2-benzene, 1,3-benzene, 1,4-benzene, 1,2-naphthalene, 1,4-naphthalene, 2,3-naphthalene and phenol-2,6-diyl, heteroaryl: selected from the group consisting of: pyridinyl; pyrimidinyl; quinolinyl; pyrazolyl; triazolyl; isoquinolinyl; imidazolyl; and oxazolidinyl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; and piperazinyl, amine: the group —$N(R)_2$, wherein each R is independently selected from: hydrogen; C1–C6-alkyl; and benzyl, halogen: selected from the group consisting of: F and Cl, sulphonate: the group —$S(O)_2OR$, wherein R is selected from: hydrogen; C1–C6-alkyl; Na; K; Mg; and Ca, sulphate: the group —$OS(O)_2OR$, wherein R is selected from: hydrogen; C1–C6-alkyl; Na; K; Mg; and Ca, sulphone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR'2, wherein each R' is independently selected from: hydrogen; C1–C6-alkyl; and benzyl, phosphonate: the group —P(O) $(OR)_2$, wherein each R is independently selected from: hydrogen; C1–C6-alkyl, benzyl; Na; K; Mg; and Ca, phosphate: the group —OP(O) $(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —$P(O)R_2$, wherein R is independently selected from: hydrogen; C1–C6-alkyl; benzyl and amine selected from the group: —NR'2, wherein each R' is independently selected from: hydrogen; C1–C6-alkyl; and benzyl.

Other compounds or ligands forming complexes with transition metals, and which are capable of catalysing bleaching by atmospheric oxygen, are suitable as organic substances in the liquid bleaching compositions of the present invention. These include the classes of complexes of a transition metal coordinated to a macropolycyclic ligand disclosed in WO-A-98/39098 and WO-A-98/39406.

The liquid bleaching compositions according to the present invention may be used for laundry cleaning, hard surface cleaning (including cleaning of lavatories, kitchen work surfaces, floors, mechanical ware washing etc.). As is generally known in the art, bleaching compositions are also employed in waste-water treatment, pulp bleaching during the manufacture of paper, leather manufacture, dye transfer inhibition, food processing, starch bleaching, sterilisation, whitening in oral hygiene preparations and/or contact lens disinfection.

In the context of the present invention bleaching should be understood as relating generally to the decolourisation of stains or of other materials attached to or associated with a substrate. However, it is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as being restricted to any bleaching mechanism or process that does not require the presence of light or activation by light. Thus, photobleaching compositions and processes relying on the use of photobleach catalysts or photobleach activators and the presence of light are excluded from the present invention.

In typical washing compositions the level of the organic substance is such that the in-use level is from 0.05 $\mu$M to 50 mM, with preferred in-use levels for domestic laundry operations falling in the range 1 to 100 $\mu$M. Higher levels may be desired and applied in industrial bleaching processes, such as textile and paper pulp bleaching.

Preferably, the aqueous medium has a pH in the range from pH 6 to 13, more preferably from pH 6 to 11, and most preferably from 7 to 10.

The liquid bleaching composition of the present invention has particular application in detergent formulations, especially for laundry cleaning. Accordingly, in another preferred embodiment, the present invention provides a liquid detergent bleach composition comprising a liquid bleaching composition as defined above and additionally a surface-active material, optionally together with detergency builder. In addition, the liquid bleaching composition may optionally contain soluble and non-soluble enzymes, enzyme stabiliser systems, functional polymers, polymers to modify the appearance and sensory properties of the liquid bleaching composition and optionally other minors such as a perfume or a fluorescer.

The liquid bleach composition according to the present invention may for example contain a surface-active material in an amount of from 10 to 50% by weight. The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl groups containing from about 8 to about 22 carbon atoms, the term "alkyl" being used to include the alkyl portion of higher aryl groups. Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; sodium and ammonium ($C_7$–$C_{12}$) dialkyl sulphosuccinates; and olefin sulphonates, which term is used to describe material made by reacting olefins, particularly ($C_{10}$–$C_{20}$) alpha-olefins, with $SO_3$ and then neutralising and hydrolysing the reaction product. The preferred anionic detergent compounds are sodium ($C_{10}$–$Cl_5$) alkylbenzene sulphonates, and sodium ($C_{16}$–$C_{18}$) alkyl ether sulphates.

Examples of suitable nonionic surface-active compounds which may be used, preferably together with the anionic surface-active compounds, include, in particular, the reaction products of alkylene oxides, usually ethylene oxide, with alkyl ($C_6$–$C_{22}$) phenols, generally 5–25 EO, i.e. 5–25 units of ethylene oxides per molecule; and the condensation products of aliphatic ($C_8$–$C_{18}$) primary or secondary linear or branched alcohols with ethylene oxide, generally 2–30 EO. Other so-called nonionic surface-actives include alkyl polyglycosides, sugar esters, long-chain tertiary amine oxides, long-chain tertiary phosphine oxides and dialkyl sulphoxides. The non-ionic surfactant liquid may be applied/added in the form of a water-soluble sachet.

Amphoteric or zwitterionic surface-active compounds can also be used in the compositions of the invention. If any amphoteric or zwitterionic detergent compounds are used, it is generally in small amounts in compositions based on the much more commonly used synthetic anionic and nonionic actives.

The liquid detergent bleach composition of the invention may comprise from 1 to 40% wt of anionic surfactant and from 0 to 40% by weight of nonionic surfactant. The liquid detergent may contain any mixture of non-ionic, anionic, cationic zwitterionic or combination thereof. Optionally, fatty acid soaps (0–30%) may be present. The liquid detergent bleach composition of the present invention may also contains a detergency builder, for example in an amount of from about 5 to 80% by weight, preferably from about 10 to 60% by weight.

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP—A-0,384,070.

In particular, the liquid bleaching compositions of the invention may contain any one of the organic and inorganic builder materials, though, for environmental reasons, phosphate builders are preferably omitted or only used in very small amounts. Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is preferred that the liquid bleaching composition contains not more than 5% by weight of a carbonate builder, expressed as sodium carbonate, more preferably not more than 2.5% by weight to substantially nil, if the composition pH lies in the lower alkaline region of up to 10.

Apart from the components already mentioned, the liquid bleaching composition of the present invention can contain any of the conventional additives in amounts of which such materials are normally employed in fabric washing detergent compositions. Examples of these additives include buffers such as carbonates, lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; stabilisers, such as phosphonic acid derivatives (i.e. Dequest® types); fabric softening agents; inorganic salts and alkaline buffering agents, such as sodium sulphate and sodium silicate; and, usually in very small amounts, fluorescent agents; perfumes; enzymes, such as proteases, cellulases, lipases, amylases and oxidases; germicides and colourants.

Transition metal sequestrants such as EDTA, and phosphonic acid derivatives such as EDTMP (ethylene diamine tetra(methylene phosphonate)) may also be included, in addition to the organic substance specified, for example to improve the stability sensitive ingredients such as enzymes, fluorescent agents and perfumes, but provided the composition remains bleaching effective. However, the liquid bleaching composition according to the present invention containing the organic substance, is preferably substantially, and more preferably completely, devoid of transition metal sequestrants (other than the organic substance).

Whilst the present invention is based on the catalytic bleaching of a substrate by atmospheric oxygen or air, it will be appreciated that small amounts of hydrogen peroxide or peroxy-based or -generating systems may be included in the liquid composition, if desired, provided that the chemical and physical stability of the composition is not thereby adversely affected to an unacceptable level. Therefore, by "substantially devoid of peroxygen bleach or peroxy-based or -generating bleach systems" is meant that the liquid bleaching composition contains from 0 to 50%, preferably from 0 to 10%, more preferably from 0 to 5%, and optimally from 0 to 2% by molar weight on an oxygen basis, of peroxygen bleach or peroxy-based or -generating bleach systems. Preferably, however, the liquid bleaching composition will be wholly devoid of peroxygen bleach or peroxy-based or -generating bleach systems.

Thus, at least 10%, preferably at least 50% and optimally at least 90% of any bleaching of the substrate is effected by oxygen sourced from the air.

According to the fourth aspect, the organic substance in the liquid bleaching composition may be contacted to the textile fabric in any suitable manner. For example, it may be applied in a liquor that is then dried, for example as an aqueous spray-on fabric treatment fluid or a wash liquor for laundry cleaning, or a non-aqueous dry cleaning fluid or spray-on aerosol fluid. Other suitable means of contacting the organic substance in liquid form to the textile may be used, as further explained below.

Any suitable textile that is susceptible to bleaching or one that one might wish to subject to bleaching may be used. Preferably the textile is a laundry fabric or garment.

In a preferred embodiment of the fourth aspect, the method is carried out on a laundry fabric using an aqueous treatment liquor. In particular, the treatment may be effected in a wash cycle for cleaning laundry. More preferably, the treatment is carried out in an aqueous detergent bleach wash liquid. In a preferred embodiment, the treated textile is dried, by allowing it to dry under ambient temperature or at elevated temperatures.

The bleaching method of the fourth aspect may be carried out by simply leaving the substrate in contact with the organic substance in the liquid bleaching composition for a sufficient period of time. Preferably, however, the organic substance is in an aqueous medium, and the aqueous medium on or containing the substrate is agitated.

In a preferred embodiment of the fourth aspect, the treated textile is dried, by allowing it to dry under ambient temperature or at elevated temperatures.

In a particularly preferred embodiment the method according to the fourth aspect is carried out on a laundry fabric using aqueous treatment liquor. In particular the treatment may be effected in, or as an adjunct to, an essentially conventional wash cycle for cleaning laundry. More preferably, the treatment is carried out in an aqueous detergent wash liquor. Preferably, the organic substance is delivered into the wash liquor from a liquid concentrate.

It is particularly advantageous that the organic substance in liquid composition used in the method of the fourth aspect makes use of atmospheric oxygen in its bleaching activity. This avoids the requirement that peroxygen bleaches and/or other relatively large quantities of reactive substances need be used in the treatment process. Consequently, only a relatively small quantity of bleach active substance in liquid composition need be employed and this allows dosage routes to be exploited, which could previously not be used. Thus, while it is preferable to include the organic substance in a liquid composition that is normally used in a washing process, such as a pre-treatment, main-wash, conditioning composition or ironing aid, other means for ensuring that the organic substance is present in the wash liquor may be envisaged.

For example, it is envisaged that the organic substance in the liquid composition can be presented in the form of a body from which it is slowly released during the whole or part of the laundry process. Such release can occur over the course of a single wash or over the course of a plurality of washes. In the latter case it is envisaged that the organic substance in liquid composition can be released from a carrier substrate used in association with the wash process, e.g. from a body placed in the dispenser drawer of a washing machine, elsewhere in the delivery system or in the drum of the washing machine. When used in the drum of the washing machine the carrier can be freely moving or fixed relative to the drum. Such fixing can be achieved by mechanical means, for example by barbs that interact with the drum wall, or employ other forces, for example a magnetic force. The modification of a washing machine to provide for means to hold and retain such a carrier is envisaged similar means being known from the analogous art of toilet block manufacture. Freely moving carriers such as shuttles for dosage of surfactant materials and/or other detergent ingredients into the wash can comprise means for the release of the organic substance in the liquid composition into the wash.

In the alternative, the organic substance can be presented in the form of a liquid wash additive that preferably is soluble. Dosage of the additive can be unitary or in a quantity determined by the user. While it is envisaged that such additives can be used in the main washing cycle, the use of them in the conditioning or drying cycle is not hereby excluded.

The present invention is not limited to those circumstances in which a washing machine is employed, but can be applied where washing is performed in some alternative vessel. In these circumstances it is envisaged that the organic substance in liquid composition can be delivered by means of slow release from the bowl, bucket or other vessel which is being employed, or from any implement which is being employed, such as a brush, bat or dolly, or from any suitable applicator for liquid compositions.

Suitable pre-treatment means for application of the organic substance from the liquid composition to the textile material prior to the main wash include sprays, pens, roller-ball devices and impregnated cloths or cloths containing microcapsules. Such means are well known in the analogous art of deodorant application and/or in spot treatment of textiles. Similar means for application are employed in those embodiments where the organic substance in liquid composition is applied after the main washing and/or conditioning steps have been performed, e.g. prior to or after ironing or drying of the cloth. For example, the organic substance in liquid composition may be applied using tapes, sheets or sticking plasters coated or impregnated with the substance, or containing microcapsules of the substance. The organic substance in liquid composition may for example be incorporated into a drier sheet so as to be activated or released during a tumble-drier cycle, or the organic substance in liquid composition can be provided in an impregnated or microcapsule-containing sheet so as to be delivered to the textile when ironed.

The invention will now be further illustrated by way of the following non-limiting examples:

EXAMPLES

Example 1

This example describes a synthesis of the catalyst as employed in Example 2:

(i) Preparation of MeN4Py ligand:

N,N-bis(pyridin-2-yl-methyl)-1,1-bis(pyridin-2-yl)-1-aminoethane, MeN4Py, was prepared according to the procedure found in EP 0 909 809 A.

(ii) Synthesis of the complex $FeMeN4PyCl_2$:

MeN4Py ligand (33.7 g; 88.5 mmoles) was dissolved in 500 ml dry methanol. Small portions of $FeCl_{24}.H_2O$ (0.95eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under vacuum (40° C.). El. Anal. Calc. for [Fe(MeN4py)Cl]Cl.$2H_2O$: C 53.03; H 5.16; N 12.89; Cl 13.07; Fe 10.01%. Found C 52.29/52.03; H 5.05/5.03; N 12.55/12.61; Cl: 12.73/12.69; Fe: 10.06/10.01%.

Example 2

Experiments with the $FeMeN4PyCl_2$ complex in a variety of liquid detergents were performed to establish bleaching activity in various liquid detergent formulations and to determine stability upon storage.

$FeMeN4PyCl_2$ complex was added to several liquid detergent products and the stability and activity observed during storage.

The following commercially available liquid detergent compositions were used as base liquids: a) WISK™ liquid USA, 1999; b) OMO™ liquid NL, 1999; c) OMO-liquido™ Brazil, 1999; and d) Rinse conditioner (Robijn™-NL).

Incorporation of $FeMeN4PyCl_2$ in Liquid Detergents:

$FeMeN4PyCl_2$ was incorporated by post dosing a stock solution of 0.01 g/ml using an electrical stirrer (125 rpm, Heidolph RZR 2101). The final concentration in the product was 0.1% for all products. To the reference a same amount of water was added by post dosing to compensate for the post dose volume of the stock solution.

The activity of $FeMeN4PyCl_2$ was measured by washing tomato oil (TO) cloth samples in mini bottles for 15 minutes at a temperature of 25° C. and a dosage of 2 g/l product at 10° FH. All of the liquids prepared were initially stable and homogeneous.

The following table lists compositions prepared. As detailed above base liquids a) to d) have had $FeMeN4PyCl_2$ incorporated therein. Compositions 5 to 8 are control liquids without added $FeMeN4PyCl_2$.

| Composition No. | |
|---|---|
| | Liquids |
| 1 | Wisk ™ liquid USA, 1999 |
| 2 | OMO ™ liquid NL, 1999 |
| 3 | OMO-liquido ™ Brazil, 1999 |
| 4 | Rinse conditioner (Robijn ™ - NL) |
| | Reference Liquids |
| 5 | Wisk ™ liquid USA, 1999 |
| 6 | OMO ™ liquid NL, 1999 |
| 7 | OMO ™ -liquido ™ Brazil, 1999 |
| 8 | Rinse conditioner (Robijn ™ - NL) |

Cloth samples were washed in mini bottles with a liquid-:cloth ratio of 1:20 and the samples were dried in a tumble dryer.

Bleaching activity was measured directly after the wash (after 2 hours), and after 1 one-day (24 hours) storage in the dark in order to establish post wash bleach effects. The five liquid formulations were stored under ambient conditions and the cleaning activity of the formulations without and with $FeMeN4PyCl_2$ was determined after certain periods of times. The times were immediately after preparation, and after 1, 2, 3, 4 and 6 weeks of storage. After the wash, the cloths were dried in a tumble drier and the reflectance was measured with a Minolta™ 3700d spectrophotometer at 460 nm. The difference in reflectance before and after the wash is defined as a ΔR460 value.

Tabulated results are shown in Tables 1 to 6 below.

TABLE 1

| Directly after preparation 10 FH, 2 g/l, T = 25 C | TO-stain ΔR 460 2 hours after washing | | TO-stain ΔR 460 1 day after washing | |
|---|---|---|---|---|
| Triplicate measurements | average | stdv | average | Stdv |
| Composition 5 | 14.3 | 1.6 | 26.6 | 3.1 |
| Composition 1 | 16.5 | 1.4 | 34.6 | 0.6 |
| Composition 6 | 12.9 | 0.7 | 20.0 | 2.9 |
| Composition 2 | 17.2 | 1.4 | 35.7 | 0.8 |
| Composition 7 | 16.2 | 0.6 | 24.4 | 5.2 |
| Composition 3 | 23.8 | 1.6 | 37.1 | 1.0 |
| Composition 8 | 4.8 | 1.1 | 6.6 | 0.8 |
| Composition 4 | 5.9 | 0.9 | 15.5 | 1.0 |

TABLE 2

| 1 week after preparation 10 FH, 2 g/l, T = 25 C | TO-stain ΔR 460 2 hours after washing | | TO-stain ΔR 460 1 day after washing | |
|---|---|---|---|---|
| Triplicate measurements | average | stdv | average | Stdv |
| Composition 5 | 11.8 | 1.3 | 13.1 | |
| Composition 1 | 18.5 | 0.7 | 36.6 | |
| Composition 6 | 11.2 | 0.4 | 12.8 | |
| Composition 2 | 14.9 | 0.4 | 37.4 | |
| Composition 7 | 13.6 | 0.4 | 18.9 | |
| Composition 3 | 19.9 | 2.7 | 39.3 | |
| Composition 8 | 4.1 | 1.0 | 5.5 | |
| Composition 4 | 3.7 | 0.8 | 12.6 | |

TABLE 3

| 2 weeks after preparation 10° FH, 2 g/l, T = 25 C | TO-stain ΔR 460 2 hours after washing | | TO-stain ΔR 460 1 day after washing | |
|---|---|---|---|---|
| Triplicate measurements | average | stdv | average | Stdv |
| Composition 5 | 11.7 | 1.4 | 16.5 | 1.3 |
| Composition 1 | 20.2 | 0.9 | 34.0 | 0.8 |
| Composition 6 | 12.1 | 0.3 | 16.2 | 3.3 |
| Composition 2 | 14.8 | 0.1 | 34.5 | 0.7 |
| Composition 7 | 14.7 | 0.1 | 17.6 | 1.5 |
| Composition 3 | 19.7 | 2.4 | 35.2 | 1.3 |
| Composition 8 | 3.9 | 0.8 | 5.4 | 0.7 |
| Composition 4 | 4.1 | 0.3 | 11.4 | 0.8 |

TABLE 4

| 3 weeks after preparation 10° FH, 2 g/l, T = °25 C | TO-stain ΔR 460 2 hours after washing | | TO-stain ΔR 460 1 day after washing | |
|---|---|---|---|---|
| Triplicate measurements | average | stdv | average | Stdv |
| Composition 5 | 13.5 | 0.6 | 16.9 | 2.5 |
| Composition 1 | 14.1 | 1.7 | 33.8 | 1.0 |
| Composition 6 | 12.8 | 0.5 | 17.6 | 3.2 |
| Composition 2 | 14.5 | 0.5 | 34.1 | 1.4 |
| Composition 7 | 16.1 | 1.8 | 18.8 | 4.5 |
| Composition 3 | 16.6 | 0.9 | 33.9 | 0.3 |
| Composition 8 | 3.1 | 0.7 | 4.2 | 1.6 |
| Composition 4 | 3.9 | 0.8 | 7.8 | 1.2 |

TABLE 5

| 4 weeks after preparation 10° FH, 2 g/l, T = 25° C. | TO-stain ΔR 460 2 hours after washing | | TO-stain ΔR 460 1 day after washing | |
|---|---|---|---|---|
| Triplicate measurements | average | stdv | average | Stdv |
| Composition 5 | 12.1 | 1.1 | 15.0 | 2.2 |
| Composition 1 | 17.8 | 1.7 | 34.5 | 1.2 |
| Composition 6 | 12.3 | 0.8 | 15.2 | 1.9 |
| Composition 2 | 16.5 | 1.7 | 34.2 | 1.5 |
| Composition 7 | 14.1 | 1.9 | 16.7 | 1.6 |
| Composition 3 | 14.5 | 0.1 | 28.3 | 1.3 |
| Composition 8 | 3.5 | 0.6 | 5.0 | 1.0 |
| Composition 4 | 3.4 | 2.1 | 9.5 | 1.9 |

TABLE 6

| 6 weeks after preparation 10° FH, 2 g/l, T = 25° C. | TO-stain ΔR 460 2 hours after washing | | TO-stain ΔR 460 1 day after washing | |
|---|---|---|---|---|
| Triplicate measurements | average | stdv | average | Stdv |
| Composition 5 | 14.8 | 0.9 | 15.8 | 1.5 |
| Composition 1 | 18.7 | 1.6 | 34.3 | 1.4 |
| Composition 6 | 15.2 | 1.0 | 15.5 | 1.3 |
| Composition 2 | 16.8 | 0.7 | 31.0 | 1.4 |
| Composition 7 | 19.1 | 0.7 | 19.8 | 1.5 |
| Composition 3 | 16.9 | 0.7 | 17.1 | 0.6 |
| Composition 8 | 6.2 | 0.7 | 7.1 | 0.5 |
| Composition 4 | 6.1 | 0.3 | 7.3 | 0.5 |

Example 3

10 Composition 5 Wisk™ liquid USA, 1999
Composition 6 OMO™ liquid NL, 1999
Composition 7 OMO-liquido™ Brazil, 1999
Composition 9 non-aqueous liquid formulation:

| Ingredient | Wt % |
|---|---|
| Nonionic surfactant | 26.6 |
| Monopropylene glycol | 5.5 |
| Pigment premix | 0.017 |
| Glycerol | 21.36 |
| Monoethanolamine | 7.56 |
| Oleic fatty acid | 13.10 |
| Water | Up to 100 |
| Linear alkyl benzene sulfonate | 20.1 |
| Perfume | 1.6 |
| Protease Enzyme | 1.0 |

In all experiments, 2 g/l of the above formulation was used, with either 2.5 or 5 microM of metal complex 1-8, or 2.5 or 5 microM of the ligand 1-8 dissolved in the wash liquor. In all cases tomato stains were used and treated further as described for Example 3. The cloths were measured immediately after drying and after 24 h storage (expressed as ΔR 460 bleaching value (a higher value indicates a cleaner cloth).

Ligand 1: N,N-bis(pyridin-2-yl-methyl)-1,1-bis(pyridin-2-yl)-1-aminoethane (MeN4py).

Ligand 2: N,N-bis(pyridin-2-yl-methyl)-1,1-bis(pyridin-2-yl)-1-amino-2-phenylethane (BzN4py). The synthesis of ligand 2 has been disclosed in EP 0909 809.

Ligand 3: N,N-bis(pyridin-2-yl-methyl)-1,1-bis(pyridin-2-yl)-aminomethane (N4py). The synthesis of ligand 3 has been disclosed in Wo-A-9534628.

Ligand 4: N,N,N',N'-tetrakis(pyridin-2ylmethyl)ethanediamine (tpen). Ligand 4 was synthesised according to a modified literature procedure (see G. Anderegg, F. Wenk, Helv. Chim. Acta, 50(8), 2330 (1967).

Trispicen-NH (5.95 g, 17.9 mmol) and 1.67 g (18.4 mmol) of 2-pyridinecarboxaldehyde were dissolved in 120 ml 1,2-dichloroethane. To this mixture $NaBH(OAc)_3$ (18 mmol) was added and the mixture was refluxed for 16 h. Subsequently 50 ml of 5 N NaOH and after 1 h stirring the organic layer was separated and the water layer was further extracted with dichloromethane. After drying the organic layers over sodium sulfate, filtration and evaporation of the solvents, a semi-solid paste was obtained that was purified over an alumina column (elutant: ethyl acetate/hexane/triethylamine 9:10:1). The oil isolated become now solid and could be crystallised from ethyl acetate/hexane (1/1) yielding a pale-brown powder (4.45 g, 10.5 mmol; 58.6%). $^1$H-nmr ($CDCl_3$) δ 2.78 (s, 4H); 3.75 (s, 8H); 7.0 (m, 4H); 7.38 (m, 4H); 7.50 (m, 4H); 8.43 (m, 4H)

Ligand 5: N-methyl-N,N',N'-tris(3-methyl-pyridin-2ylmethyl)ethane-diamine (trilen). The synthesis of ligand 5 has been disclosed in EP 1001 009.

Ligand 6: N,N,N'-tris(pyridin-2ylmethyl)ethane-diamine (trispicen-NH).

First N,N'-bis(pyridin-2ylmethyl)-ethanediamine (bispicen) was synthesised by the following procedure. Ethylenediamine (26 ml, 0.38 mol) was dissolved in 200 ml dry methanol. To this mixture 74 ml (0.76 mol) pyridincarboxaldehyde was added. The mixture was refluxed for 2 h, after which the mixture was left to cool to RT and in small portions 40 g of $NaBH_4$ was added. The mixture was subsequently stirred for 16 h at RT. The methanol was evaporated and 500 ml of water was added. The aqueous mixture was extracted by three portions of dichloromethane (100 ml) and the dichloromethane solution was dried over sodium sulfate, filtered off and the solvent was removed. The dark oil containing N,N'-bis(pyridin-2ylmethyl)-ethanediamine (73.7 g; 81%) was analysed by NMR and used without further purification. $^1$H-nmr ($CDCl_3$) δ 2.20 (br, NH); 2.78 (s, 4H); 3.85 (s, 4H); 7.00–7,7.40 (m, 4H); 7.58 (m, 2H); 8.45 (m, 2H).

In the second step the aminal of bispicen with 2-pyridincarboxaldehyde was synthesised. 73,7 g of the unpurified bispicen material (see above) was under argon dissolved in 750 ml of dry diethyether (distilled over $P_2O_5$. To this solution 32.8 of 2-pyridincarboxaldehyde was added, the reaction mixture was stirred and cooled in an ice/water bath. After 20 min a white precipitate was formed that was filtered off (P4-glass filter) and dried with dry ether. The yield was 66.6 g (66%) and was used without further purification. $^1$H-nmr ($CDCl_3$): δ 2.75 (m, 2H); 3.13 (m, 2H) 3.65 (d, 2H); 4.93 (d, 2H); 4.23 (s, 1H); 7.00–7.90 (m, 9H) 8.43 (m, 3H).

In the third step the desired ligand was obtained (N,N,N'-tris(pyridin-2ylmethyl)ethane-diamine-trispicen-NH). The aminal (45.0 g; 0.135 mol), obtained as described as above, was dissolved in 1.2 l of dry methanol (distilled over Mg), and to this mixture 8.61 g (0.137 mol) of $NaBCNH_3$ was added in small portions. Subsequently 21 ml of trifluoroacetic acid was added dropwise in the solution. The mixture was stirred for 16 h at RT and subsequently 1.05 L of 5N NaOH was added and the mixture was stirred for 6 h. Extraction with dichloromethane yielded after drying, filtration and removal of the solvent a yellow oil as product (42.7 g 0.128 mol; 95%. $^1$H-nmr ($CDCl_3$): δ 2.15 (br, NH); 2.75 (s, 4H); 3.80 (s, 4H); 3.82 (s, 2H); 7.0–7.8 (m, 3H); 7.45–7.70 (m, 6H); 8.40–8.60 (m, 3H). $^{13}$C-nmr ($CDCl_3$): δ 53.9 (t); 54.7 (t); 60.4 (t); 121.7 (d); 121.9 (d); 122.1 (d); 123.0 (d); 136.3 (d); 136.4 (d); 148.9 (d); 149.1 (d); 159.3 (s); 159.6 (s).

Ligand 7: N-methyl-,N,N'N'-tris(pyridin-2ylmethyl) ethane-diamine (trispicen-NMe). Ligand 7 was prepared according to a modified procedure described by Bernal et al (J. Chem. Soc., Dalton Trans, 22, 3667 (1995)).

Trispicen-NH (10 g, 30 mmol) was dissolved in 25 ml formic acid and 10 ml water. To this mixture 36% formaldehyde solution was added (16 ml, 90 mmol) and the mixture was warmed up till 90° C. for 3 h. Formic acid was evaporated and the 2.5 N NaOH solution was added until the pH was higher than 9. Extraction by dichloromethane and drying over sodium sulfate, filtration of the solution and subsequently drying yielded a dark-coloured oil (8.85 g). The oil was purified over a alumina column (elutant:ethyl acetate/hexane/triethylamine 9:10:1). Yield 7,05 g pale yellow oil (20,3 mmoles; 68%). $^1$H-nmr ($CDCl_3$): δ 2.18 (s, 3H); 2.65 (m, 2H); 2.75 (m, 2H); 3.60 (s; 2H); 3.83 (s; 4H); 7.10 (m, 3H); 7.3–7.6 (m, 6H); 8.5 (d, 3H)

Ligand 8: tris(pyridin-2-ylmethyl)amine (tpa) Ligand 8 was prepared according to literature procedures (see G. Anderegg, F. Wenk, Helv. Chim. Acta, 50(8), 2330 (1967).

Complex 1: [(MeN4Py)FeCl]Cl

The synthesis of Complex 1 is described in Example 1.

Complex 2: [(BzN4Py)Fe($CH_3CN$)] $(ClO_4)_2$

The synthesis of Complex 2 is described in EP 0909 809. An optimised synthetic procedure is given below: 3.0 g (6.56 mmol) of BzN4Py was dissolved in 30 ml methanol and 30 ml acetonitrile. 2.26 g (6.23 mmol) of $Fe(Cl0_4).6H_2O$ (Aldrich) was added to solution containing the ligand in small portions. To the dark-red coloured solution in total 100 ml of ethyl acetate was added to facilitate the crystallisation procedure. After 18 h stirring, the red powder was filtered off, washed with ethyl acetate and dried, yielding 3.85 g of the desired complex (anal: see EP 0909 809).

Complex 3: [(N4Py)FeCl]Cl

Complex 3 was synthesised according to the procedure as described for the analogous MeN4py complex using now N4py as ligand (see example 1).

Complex 4: [(tpen)Fe] $(ClO_4)_2$

Complex 4 was prepared according to the procedure found in H. Toftlund et al., J.Am. Chem. Soc., 112, 6814 (1990)

Complex 5: [(trilen)FeCl]$PF_6$

Complex 5 was prepared according to EP 1001 009

Complex 6: [(trispicen-NH)FeCl]$PF_6$

Trispicen-NH (8.0 g; 24.0 mmol) was dissolved in 60 ml methanol/water 1/1 v/v) and was heated till 50° C. $FeCl_2.4H_2O$ 4,78 g; 24, 0 mmoles) was added in small portions. The dark blue-purple solution was stirred for 10 min at 50° C. Subsequently 4.42 g (24 mmol) of $KPF_6$ was added and the solution was stirred for 2 days at RT. The dark powder was filtered, washed with methanol/water and then with ethyl acetate. The powder was dried in the air. Yield 11.6 g.

Complex 7: [(trispicen-NMe) FeCl]$PF_6$

TrispicenNMe (6,0 g; 17,3 mmoles) was dissolved in 15 ml methanol/water 1/1 v/v) and was heated till 50° C. $FeCl_{24}.l\ H_2O$ 3,43 g; 17, 0 mmoles), dissolved in 20 ml water/methanol 1/1), was added. The dark solution was stirred for 20 min at 50° C. Subsequently 3.17 g (17 mmol) of $KPF_6$ dissolved in 10 ml water, was added and the solution was stirred for 15 h to yield a yellow precipitation. The solid was filtered off, wasged with methanol/water 1/1, v/v) and ethyl acetate. Drying yielded 8.25 g of a pale-yellow powder.

Complex 8: $[Fe_2(tpa)_2(H_2O)_2]$ $(Cl0_4)_2$

Complex 8 was kindly donated by Prof. L. Que, University of Minnesota, USA (references: L. Que et al., Inorg Chim. Acta, 273, 393 (1998) and H. Toftlund et al., Inorg. Chem., 33, 3127 (1994).

TABLE 7

Bleaching results obtained on tomato stains for the different complexes (5 microM) in solutions containing the four liquid formulations (compositions 5, 6, 7 and 9). The bleaching results obtained immediately after drying (t = 0) and after 1 day storage are shown. All values expressed in ΔR 460 values; typical errors are in the order of 2 points.

| | Comp 5 | | Comp 6 | | Comp 7 | | Comp 9 | |
|---|---|---|---|---|---|---|---|---|
| | t = 0 | t = 1 | t = 0 | t = 1 | t = 0 | t = 1 | t = 0 | t = 1 |
| Complex 1 | 20 | 50 | 41 | 47 | 35 | 55 | 42 | 49 |
| Complex 2 | 20 | 48 | 42 | 50 | 31 | 51 | 42 | 52 |
| Complex 3 | 31 | 49 | 35 | 50 | 31 | 53 | 44 | 52 |
| Complex 4 | 16 | 39 | 16 | 23 | 26 | 48 | 29 | 42 |
| Complex 5 | 33 | 47 | 36 | 46 | 39 | 52 | 43 | 50 |
| Complex 6 | 15 | 22 | 12 | 15 | 16 | 23 | 15 | 18 |
| Complex 7 | 19 | 39 | 17 | 20 | 25 | 46 | 27 | 33 |
| Blank | 11 | 13 | 15 | 19 | 13 | 14 | 15 | 18 |

From these results is clear that especially complexes 1, 2, 3, and 5 give a good tomato stain bleaching with air, although the exact amount depends on the formulation employed. Complexes 4, 6, and 7 give somewhat lower bleaching activity, but still in most cases more than the blanks.

TABLE 8

Bleaching results obtained on tomato stains for the different ligands (5 microM) in solutions containing the four liquid formulations (compositions 5, 6, 7 and 9). The bleaching results obtained immediately after drying (t = 0) and after 1 day storage are shown. All values expressed in ΔR 460 values; typical errors are in the order of 2 points.

| | Comp 5 | | Comp 6 | | Comp 7 | | Comp 9 | |
|---|---|---|---|---|---|---|---|---|
| | t = 0 | t = 1 | t = 0 | t = 1 | t = 0 | t = 1 | t = 0 | t = 1 |
| Ligand 1 | 16 | 42 | 22 | 44 | 18 | 32 | 33 | 52 |
| Ligand 2 | 16 | 40 | 26 | 47 | 16 | 34 | 32 | 51 |
| Ligand 3 | 18 | 37 | 19 | 39 | 18 | 39 | 33 | 53 |
| Ligand 5 | 22 | 40 | 26 | 36 | 19 | 36 | 41 | 52 |
| Ligand 6 | 14 | 16 | 14 | 16 | 14 | 20 | 18 | 20 |
| Ligand 7 | 16 | 20 | 16 | 19 | 19 | 28 | 19 | 22 |
| Blank | 11 | 13 | 14 | 19 | 12 | 14 | 15 | 18 |

All ligands in the wash liquor containing the four formulations give significant enhancement of the tomato stain bleaching in the air. This effect is especially clear for ligands 1, 2, 3 and 5.

TABLE 9

Bleaching results obtained on tomato stains for the different complexes (2.5 microM) in solutions containing the four liquid formulations (compositions 5, 6, 7 and 9). The bleaching results obtained immediately after drying (t = 0) and after 1 day storage are shown. All values expressed in ΔR 460 values; typical errors are in the order of 2 points.

| | Comp 5 | | Comp 6 | | Comp 7 | | Comp 9 | |
|---|---|---|---|---|---|---|---|---|
| | t = 0 | t = 1 | t = 0 | t = 1 | t = 0 | t = 1 | t = 0 | t = 1 |
| Complex 1 | 15 | 46 | 38 | 48 | 27 | 49 | 22 | 44 |
| Complex 2 | 22 | 46 | 15 | 35 | 28 | 47 | 18 | 38 |
| Complex 3 | 20 | 46 | 24 | 43 | 27 | 44 | 24 | 47 |
| Complex 4 | 12 | 19 | 9 | 11 | 18 | 24 | 12 | 19 |
| Complex 5 | 30 | 43 | 23 | 33 | 27 | 36 | 23 | 40 |
| Complex 6 | 9 | 10 | 8 | 9 | 16 | 23 | 13 | 14 |
| Complex 7 | 15 | 18 | 9 | 10 | 23 | 32 | 17 | 21 |
| Complex 8 | 10 | 13 | 11 | 12 | 11 | 13 | 12 | 15 |
| Blank | 10 | 11 | 9 | 10 | 12 | 14 | 11 | 12 |

TABLE 10

Bleaching results obtained on tomato stains for the different ligands (2.5 microM) in solutions containing the four liquid formulations (compositions 5, 6, 7 and 9). The bleaching results obtained immediately after drying (t = 0) and after 1 day storage are shown. All values expressed in ΔR 460 values; typical errors are in the order of 2 points.

| | Comp 5 | | Comp 6 | | Comp 7 | | Comp 9 | |
|---|---|---|---|---|---|---|---|---|
| | t = 0 | t = 1 | t = 0 | t = 1 | t = 0 | t = 1 | t = 0 | t = 1 |
| Ligand 1 | 13 | 26 | 9 | 13 | 11 | 13 | 11 | 15 |
| Ligand 2 | 11 | 19 | 10 | 14 | 10 | 13 | 13 | 21 |
| Ligand 3 | 13 | 26 | 9 | 11 | 12 | 14 | 13 | 17 |
| Ligand 5 | 13 | 20 | 9 | 11 | 12 | 16 | 14 | 19 |
| Ligand 6 | 11 | 12 | 10 | 12 | 10 | 11 | 10 | 12 |
| Ligand 7 | 12 | 15 | 9 | 11 | 10 | 12 | 13 | 15 |
| Ligand 8 | 8 | 9 | 9 | 11 | 13 | 15 | 11 | 14 |
| Blank | 10 | 11 | 9 | 10 | 11 | 14 | 11 | 12 |

Discussion of Results:

The results show that the activity of $FeMeN4PyCl_2$ is stable for six weeks in the detergent Compositions 1 and 2. However, the activity of $FeMeN4PyCl_2$ in composition 4 and in composition 3 after more than four weeks storage decreased. Without being bound by theory, it is more than likely that STP present in a liquid composition gives the negative effect on the storage stability and that addition of iron salt restores the activity. The results show that by adding a liquid composition containing a ligand or transition metal complex thereof to the wash liquor a bleaching capacity is provided without the presence of an added peroxyl species or precursor thereof. In addition, the bleaching capacity is provided at a low concentration of a ligand or transition metal complex thereof in the wash liquor.

1) $FeMeN4PyCl_2$, amongst others, gives clear bleach benefits in a variety of liquid formulations (incl. rinse conditioner) on tomato-oil stains.
2) The bleach effect upon 24 hr storage of the cloths in the dark is much larger then 2 h after the wash.
3) No visual change in structural phase after two weeks.
4) Immediate colour change upon addition of $FeMeN4PyCl_2$ of the liquid observed.
5) Similar bleach performance upon 6 weeks of storage as found immediately after mixing for the detergent Compositions 1 and 2, implying a stable system.
6) No bleach effects were more observed after 6 weeks of storage for detergent Composition 3 and rinse conditioner Composition 4.

Complex 8 and ligand 8 show significant decreased bleach benefit in a liquid bleach composition. As is known from inorganic chemistry, in general pentadentate ligands give rise to more stable complexes than tetradenate ligands; this is known as the chelate effect. (see Huheey, inorganic chemistry, $2^{nd}$ edition, Harper and Row). The decreased stability is especially noted in basic aqueous media, where formation of insoluble iron Hydroxide species are often encountered. The decreased stability of the iron tpa complexes/species gives rise to a poorer performance in the liquid detergent formulations.

There are many liquid formulations for detergents and rinse conditioners or other liquid products that may be enhanced by conferring a bleaching ability to the liquid formulation. As will be evident to one skilled in the art the present invention is applicable to known liquid formulations and liquid formulations to be developed.

As one skilled in the art will appreciate determining the suitability of a particular catalyst for bleaching of a substrate by atmospheric oxygen in a particular liquid formulation is a matter of routine experimentation. The present invention extends to both isotropic and complex liquid compositions and formulations a brief discussion of which follows. Some isotropic formulations are termed 'micro-emulsion' liquids that are clear and thermodynamically stable over a specified temperature range. The 'micro-emulsion' formulation may be water in oil, or oil in water emulsions. Some liquid formulations are macro-emulsions that are not clear and isotropic. Emulsions are considered meta-stable. Concentrated, clear compositions containing fabric softening actives have been disclosed in Wo 98/08924 and WO 98/4799, both Procter & Gamble. Such compositions comprise bio-degradable fabric conditioners. However, both disclose compositions comprising water miscible solvents that do not form water-in-oil micro-emulsions. Clear fabric conditioning compositions have also been disclosed in EP 730023 (Colgate Palmolive), WO 96/19552 (Colgate Palmolive), Wo 96/33800 (Witco Co.), WO 97/03170 (Procter & Gamble), Wo 97/03172 (Procter & Gamble), WO 97/03169 (Procter & Gamble), U.S. Pat. No. 5,492,636 (Quest Int.) and U.S. Pat. No. 5,427,697 (Procter & Gamble). Liquid formulations of the present invention may contain for example; monoethoxy quats; AQAs and bis-AQAs; cationic amides; cationic esters; amino/diamino quats; glucamide; amine oxides; ethoxylated polyethyleneimines; enhancement polymers of the form linear amine based polymers, e.g. bis-hexamethylenetriamine; polyamines e.g. TETA, TEPA or PEI polymers.

Experimentation to determine catalyst-liquid stability, as detailed above, may be varied. The aforementioned method determined the catalyst-liquid stability/compatibility by examining how the oxygen bleaching ability of a particular catalyst-liquid formulation varied with time. Alternatively, the determination may be conducted by monitoring the concentration of a particular catalyst in a liquid formulation by known techniques, for example NMR, HPLC, Liquid Chromatography-Mass Spectroscopy, Infra Red, UV-visible measurements, etc, over a period of time. Alternatively, another possible method of determining catalyst-liquid stability would be to analyse the activity of a certain transition metal compound by oxidation activity studies using a dye/compound that gives a colour change upon oxidation. An example of a dye/compound that gives a colour change upon oxidation is 2,2'-azinobis(3-ethylbenzothiazoline-6-sulfonate) and many other dyes/compounds that give a colour change upon oxidation are known. Methods for using a dye/compound that gives a colour change upon oxidation are known in the art for establishing activity of a variety of redox enzymes.

What is claimed is:

1. A bleaching composition comprising 1 to 40% of surfactant and a free ligand for bleaching a substrate with atmospheric oxygen, the free ligand being a pentadentate or hexadentate ligand of general formula (VE):

$$R^1R^1N—W—NR^1R^2 \quad \text{(VE)}$$

wherein each $R^1$ independently represents —$R^3$—V, in which $R^3$ is selected from the group consisting of an optionally substituted: alkylene; alkenylene; oxyalkylene; aminoalkylene; and, alkylene ether, V represents an optionally substituted pyridinyl group;

W represents an optionally substituted —$CH_2CH_2$— group; and $R^2$ represents a group selected from: $R^1$; alkyl; aryl; and, arylalkyl, the $R^2$ groups being optionally substituted with a substituent selected from: hydroxy; alkoxy; phenoxy; carboxylate; carboxamide; carboxylic ester; sulphonate; amine; alkylamine; and, $N^+(R^4)_3$, wherein $R^4$ is selected from the group consisting of: hydrogen; alkanyl; alkenyl; arylalkanyl; arylalkenyl; oxyalkanyl; oxyalkenyl; aminoalkanyl; aminoalkenyl; alkanyl ether; and, alkenyl ether, the ligand present in an effective amount for bleaching the substrate, wherein the composition is substantially devoid of a bleaching group selected from the group consisting of: peroxygen bleach; a peroxy-based; and, a peroxy-generating bleach system.

2. A bleaching composition according to claim 1, wherein $R^3$ is an alkylene group.

3. A bleaching composition according to claim 2, wherein $R^3$ is a methylene group.

4. A bleaching composition according to claim 1, wherein the optionally substituted pyridinyl group is a pyridin-2-yl group.

5. A bleaching composition according to claim 4, wherein the pyridin-2-yl group is a methyl- or ethyl-substituted pyridin-2-yl group.

6. A bleaching composition according to claim 4, wherein $R^2$ is selected from the group consisting of a substituted or unsubstituted: alkyl; aryl; arylalkyl; and, $R^1$.

7. A bleaching composition comprising 1 to 40% of surfactant and a free ligand for bleaching a substrate with atmospheric oxygen, the free ligand being a pentadentate or hexadentate ligand of general formula (VE):

$$R^1R^1N—W—NR^1R^2 \quad \text{(VE)}$$

wherein each $R^1$ independently represents —$R^3$—V, in which $R^3$ is an optionally substituted alkylene group, V represents an optionally substituted pyridinyl group;

W represents an optionally substituted —$CH_2CH_2$— group; and $R^2$ represents a group selected from substituted or unsubstituted alkyl; aryl; arylalkyl; and, $R^1$, the ligand present in an effective amount for bleaching the substrate, wherein the composition is substantially devoid of a bleaching group selected from the group consisting of: peroxygen bleach; a peroxy-based; and a peroxy-generating bleach system.

8. A bleaching composition according to claim 7, wherein $R^3$ is a methylene group.

9. A bleaching composition according to claim 7, wherein $R^2$ is selected from the group consisting of: methyl; ethyl; benzyl; 2-hydroxyethyl and 2-methoxyethyl.

10. A bleaching composition according to claim 9, wherein $R^2$ is selected from the group consisting of: methyl; and, ethyl.

11. A method of bleaching a substrate comprising the step of contacting the substrate in an aqueous medium with a bleaching composition to provide an aqueous bleaching medium, said bleaching composition comprising 1 to 40% of surfactant a free ligand for bleaching a substrate with atmospheric oxygen, the free ligand being a pentadentate or hexadentate ligand of general formula (VE):

$$R^1R^1N—W—NR^1R^2 \quad \text{(VE)}$$

wherein each $R^1$ independently represents —$R^3$—V, in which $R^3$ is selected from the group consisting of an optionally substituted: alkylene; alkenylene; oxyalkylene; aminoalkylene; and, alkylene ether, V represents an optionally substituted pyridinyl group;

W represents an optionally substituted —$CH_2CH_2$— group; and $R^2$ represents a group selected from: $R^1$; alkyl; aryl; and, arylalkyl, the $R^2$ groups being optionally substituted with a substituent selected from: hydroxy; alkoxy; phenoxy; carboxylate; carboxamide; carboxylic ester; sulphonate; amine; alkylamine; and, $N^+(R^4)_3$, wherein $R^4$ is selected from the group consisting of: hydrogen; alkanyl; alkenyl; arylalkanyl; arylalkenyl; oxyalkanyl; oxyalkenyl; aminoalkanyl; aminoalkenyl; alkanyl ether; and, alkenyl ether, the ligand provided by the bleaching composition to the aqueous medium in an effective amount for bleaching the substrate, wherein the aqueous bleaching medium is substantially devoid of a bleaching group selected from the group consisting of: peroxygen bleach; a peroxy-based; and, a peroxy-generating bleach system.

12. A method according to claim 11, wherein $R^3$ is an alkylene group.

13. A method according to claim 12, wherein $R^3$ is a methylene group.

14. A method according to claim 11, wherein the optionally substituted pyridinyl group is a pyridin-2-yl group.

15. A method according to claim 14, wherein the pyridin-2-yl group is a methyl- or ethyl-substituted pyridin-2-yl group.

16. A method according to claim 14, wherein $R^2$ is selected from the group consisting of a substituted or unsubstituted: alkyl; aryl; arylalkyl; and, $R^1$.

* * * * *